US012735829B2

(12) United States Patent
Lee et al.

(10) Patent No.: US 12,735,829 B2
(45) Date of Patent: Sep. 15, 2026

(54) CLOTHES TREATING APPARATUS

(71) Applicant: SAMSUNG ELECTRONICS CO., LTD., Suwon-si (KR)

(72) Inventors: Changwoo Lee, Suwon-si (KR); Younghyun Kim, Suwon-si (KR); Zoohyeong Kim, Suwon-si (KR); Jongwon Park, Suwon-si (KR); Kwanwoo Baek, Suwon-si (KR); Myungwoo Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 19/027,497

(22) Filed: Jan. 17, 2025

(65) Prior Publication Data

US 2025/0223750 A1 Jul. 10, 2025

Related U.S. Application Data

(63) Continuation of application No. PCT/KR2024/020678, filed on Dec. 19, 2024.

(30) Foreign Application Priority Data

Jan. 8, 2024 (KR) ..... 10-2024-0003214

(51) Int. Cl.
*D06F 58/04* (2006.01)
*D06F 58/20* (2006.01)
(Continued)

(52) U.S. Cl.
CPC ..... *D06F 58/04* (2013.01); *D06F 58/20* (2013.01); *D06F 25/00* (2013.01); *D06F 37/267* (2013.01); *D06F 39/12* (2013.01)

(58) Field of Classification Search
CPC ..... D06F 25/00; D06F 37/267; D06F 58/20; D06F 58/04; D06F 39/12
See application file for complete search history.

(56) References Cited

U.S. PATENT DOCUMENTS 7,743,480 B2 6/2010 Park et al.
10,590,583 B2 3/2020 Kitayama
(Continued)

FOREIGN PATENT DOCUMENTS

CN 205258934 U 5/2016
CN 113355838 A * 9/2021 ..... D06F 25/00
(Continued)

OTHER PUBLICATIONS

International Search Report and the Written Opinion of the International Searching Authority dated Apr. 10, 2025 for International Application No. PCT/KR2024/020678.

*Primary Examiner* — Benjamin L Osterhout
(74) *Attorney, Agent, or Firm* — STAAS & HALSEY LLP

(57) ABSTRACT

A clothes treating apparatus comprises a tub including a back forming a rear side of the tub, the back having a first region including a plurality of ribs, and a second region including a tub exhaust port and a recessed portion forming an exhaust path along which air discharged through the tub exhaust port is flowable, a drum inside the tub, the drum configured to be rotatable and accommodate laundry, a rotatable shaft configured to rotate the drum, a drying device to remove moisture from air discharged from the tub, heat the discharged air, and supply the heated air to the tub, a bearing housing coupled to the tub and configured to support the rotatable shaft, and a bracket including an exhaust port corresponding to the tub exhaust port, and a rigidity rein-
(Continued)

forcing portion coupled to the recessed portion to reinforce a strength of the recessed portion.

14 Claims, 20 Drawing Sheets

(51) Int. Cl.

| | |
|---|---|
| *D06F 25/00* | (2006.01) |
| *D06F 37/26* | (2006.01) |
| *D06F 39/12* | (2006.01) |

(56) References Cited

U.S. PATENT DOCUMENTS

| | | | |
|---|---|---|---|
| 2010/0287995 | A1 | 11/2010 | Mancini et al. |
| 2018/0080161 | A1 | 3/2018 | Fricke et al. |
| 2019/0024279 | A1 | 1/2019 | Lee |
| 2024/0167208 | A1 | 5/2024 | Kang et al. |

FOREIGN PATENT DOCUMENTS

| | | | | | |
|---|---|---|---|---|---|
| CN | 218436269 | U | | 2/2023 | |
| CN | 115748173 | A | | 3/2023 | |
| CN | 219603988 | U | | 8/2023 | |
| DE | 112006003872 | T5 | * | 3/2009 | ..... D06F 37/269 |
| EP | 1116812 | A1 | * | 7/2001 | ..... D06F 23/06 |
| EP | 1707662 | A2 | * | 10/2006 | ..... H02K 1/187 |
| EP | 2390400 | B1 | * | 6/2016 | ..... D06F 34/16 |
| JP | 2010-12088 | | | 1/2010 | |
| JP | 6572192 | | | 9/2019 | |
| JP | 6904921 | | | 7/2021 | |
| KR | 10-0651976 | | | 11/2006 | |
| KR | 101453267 | B1 | * | 10/2014 | ..... D06F 23/02 |
| KR | 10-1578776 | | | 12/2015 | |
| KR | 10-1686241 | | | 12/2016 | |
| KR | 10-2019-0010178 | | | 1/2019 | |
| KR | 10-2369335 | | | 3/2022 | |
| KR | 20220114165 | A | * | 8/2022 | ..... D06F 58/08 |
| KR | 20220122240 | A | * | 9/2022 | ..... D06F 58/20 |
| KR | 10-2023-0057787 | | | 5/2023 | |
| TW | 1352763 | B | * | 11/2011 | ..... D06F 58/04 |
| WO | WO-2007132955 | A1 | * | 11/2007 | ..... D06F 37/264 |

* cited by examiner

CLOTHES TREATING APPARATUS

CROSS-REFERENCE TO RELATED APPLICATIONS

This is a continuation application, under 35 U.S.C. § 111 (a), of International Application No. PCT/KR2024/020678, filed Dec. 19, 2024, which claims priority under 35 U.S.C. § 119 to Korean Patent Application No. 10-2024-0003214, filed Jan. 8, 2024, in the Korean Intellectual Property Office, the disclosures of which are incorporated herein in their entireties by reference.

TECHNICAL FIELD

The present disclosure relates to a clothes treating apparatus including a drying device.

BACKGROUND ART

A clothes treating apparatus is an apparatus for treating and/or caring for clothes. The clothes treating apparatus may include a washing machine and a dryer.

A washing machine is an apparatus for performing washing by agitating laundry, water, and a detergent put into a tub together using a driving force of a driving motor to wash the laundry by a mutual friction.

Processes that are performed by the washing machine include, regardless of the type of the washing machine, a washing process for washing laundry put into the tub by supplying a detergent and water to the tub and rotating the drum, a rinsing process for rinsing the laundry by supplying water to the tub and rotating the drum, and a spin-drying process for dewatering the laundry by discharging water from the tub and rotating the drum.

Process performed by the washing machine may include a drying process in which heat generated by a drying device is blown into a receiving space containing laundry to dry the laundry. The washing machine may include the drying device to perform the drying process.

DISCLOSURE

Technical Problem

One aspect of the disclosure provides a clothes treating apparatus capable of enhancing the internal space efficiency.

One aspect of the disclosure provides a clothes treating apparatus in which a tub back forms a portion of an exhaust path.

One aspect of the disclosure provides a clothes treating apparatus capable of preventing strength degradation due to an improved structure of a tub.

One aspect of the disclosure provides a clothes treating apparatus including a reinforcing bracket of which the structure is improved to correspond to the structure of a tub back.

The technical objectives of the present invention are not limited to the above, and other objectives that are not described above may become apparent to those of ordinary skill in the art based on the following descriptions.

Technical Solution

A clothes treating apparatus according to an embodiment comprises a tub including a tub back forming a rear side of the tub, the tub back having: a first region including a plurality of reinforcing ribs, and a second region including a tub exhaust port and a recessed portion forming an exhaust path along which air discharged through the tub exhaust port is flowable, a drum inside the tub, the drum configured to accommodate laundry and to be rotatable, a rotatable shaft connected to the drum and configured to rotate the drum, a drying device at an upper side of the tub and configured to remove moisture from air discharged from the tub along the exhaust path, heat the discharged air, and supply the heated air back to the tub through the air inlet, a bearing housing coupled to the tub and configured to support the rotatable shaft, and a reinforcing bracket including a bracket exhaust port corresponding to the tub exhaust port, and a rigidity reinforcing portion coupled to the recessed portion to reinforce a strength of the recessed portion.

A clothes treating apparatus according to an embodiment comprises a tub including a tub back having a first region, in which a plurality of reinforcing ribs protrude rearward, and a second region in which a tub exhaust port and a recessed portion are formed, a drum rotatably provided inside the tub, a drying device including a heat pump, the drying device being configured to supply heated air into the drum, a duct cover configured to cover the second region and configured to form an exhaust path for guiding air discharged from the tub exhaust port through the tub exhaust port to the drying device, a bearing housing coupled to the tub, and a reinforcing bracket including a bracket exhaust port corresponding to the tub exhaust port, and a rigidity reinforcing portion configured to be coupled to the recessed portion to reinforce rigidity of the recessed portion.

A clothes treating apparatus according to an embodiment comprises a tub including a partition rib configured to divide a first region in which a plurality of reinforcing ribs protrude, and a second region in which a recessed portion recessed from end portions of the plurality of reinforcing ribs and a tub exhaust port formed on the recessed portion are formed, a drum rotatably provided inside the tub, a drying device including a heat pump, the drying device being configured to supply heated air into the drum, a duct cover configured to cover the recessed portion to form an exhaust path such that air discharged from the drum through the tub exhaust port flows into the drying device, a bearing housing inserted into the tub, and a reinforcing bracket including a bracket exhaust port corresponding to the tub exhaust port, and a rigid reinforcing portion coupled to the recessed portion at an outer side of the bearing housing in a radial direction of the bearing housing.

MODES OF THE DISCLOSURE

Figure 1:
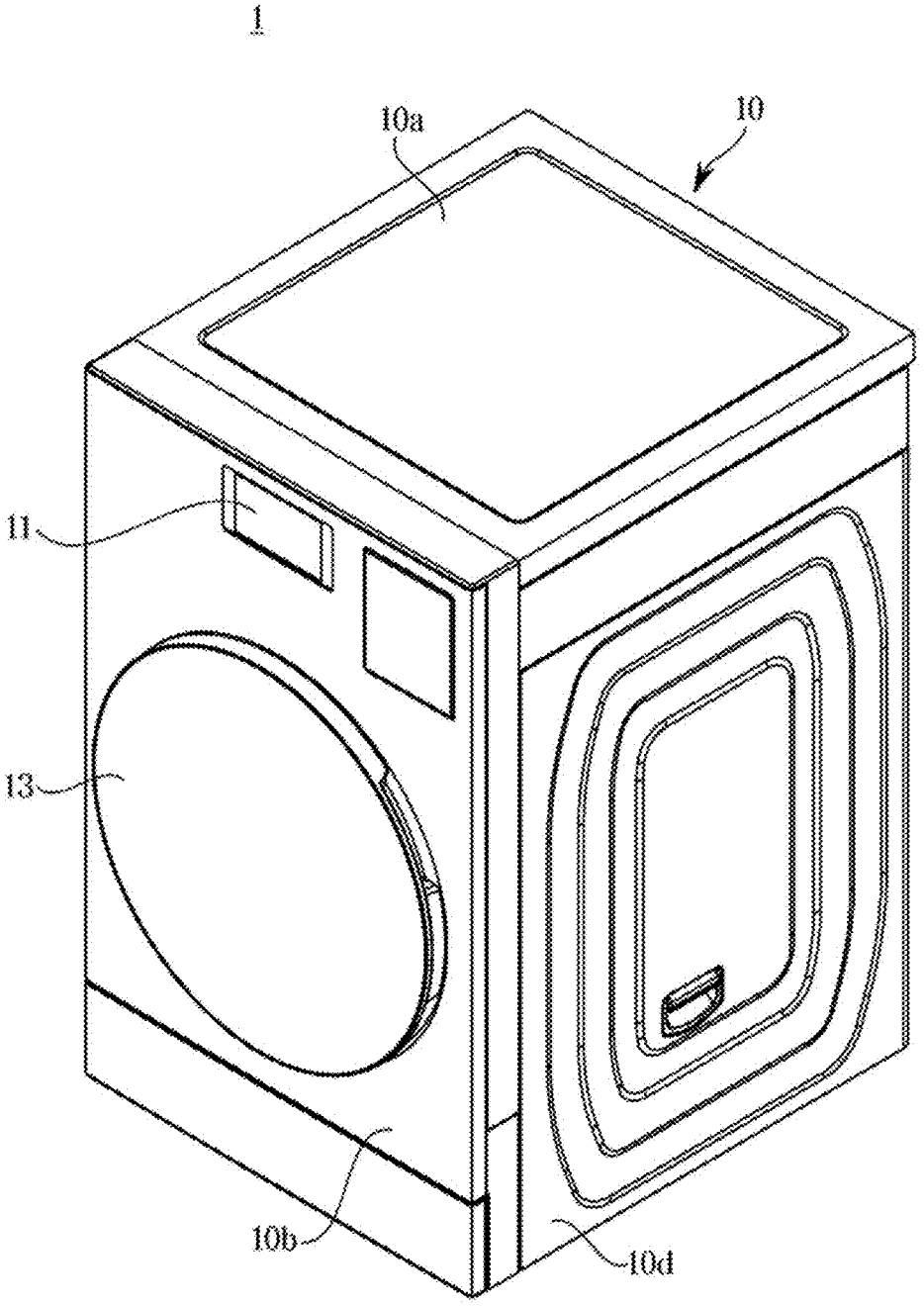
FIG. 1 is a perspective view illustrating a clothes treating apparatus according to an embodiment of the present disclosure.

Various embodiments and terms in this document are not intended to limit the technical features described in this document to specific embodiments, and should be understood to include various modifications, equivalents, or substitutes of the embodiments.

In connection with the description of the drawings, like reference numbers may be used for like or related components.

The singular form of a noun corresponding to an item may include one item or a plurality of items, unless the relevant context clearly dictates otherwise.

In this document, each of phrases such as "A or B," "at least one of A and B," "at least one of A or B," "A, B or C," "at least one of A, B and C," and "at least one of A, B, or C" may include any one of the items listed together in the corresponding one of the phrases, or all possible combinations thereof.

The term "and/or" includes any combination of a plurality of related components or any one of a plurality of related components.

Terms such as "first," "second," "primary," and "secondary" may simply be used to distinguish a given component from other corresponding components, and do not limit the corresponding components in any other aspect (e.g., importance or order).

When any (e.g., a first) component is referred to as being "coupled" or "connected" to another (e.g., a second) component with or without the terms "functionally" or "communicatively," this means that the any component may be connected to the other component directly (e.g., by a wire), wirelessly, or through a third component.

The terms "comprises," "has," and the like are intended to indicate that there are features, numbers, steps, operations, components, parts, or combinations thereof described in this document, and do not exclude the presence or addition of one or more other features, numbers, steps, operations, components, parts, or combinations thereof.

When any component is referred to as being "connected," "coupled," "supported" or "in contact" with another component, this includes a case in which the components are indirectly connected, coupled, supported, or in contact with each other through a third component as well as directly connected, coupled, supported, or in contact with each other.

When any component is referred to as being located "on" or "over" another component, this includes not only a case in which any component is in contact with another component but also a case in which another component is present between the two components.

A washing machine according to various embodiments may perform washing, rinsing, dewatering, and drying processes. The washing machine is an example of a clothes treating apparatus, and the clothes treating apparatus is a concept encompassing an apparatus for washing clothes (objects to be washed, objects to be dried), an apparatus for drying clothes, and an apparatus capable of washing and drying clothes.

Washing machines according to various embodiments may include a top-loading washing machine in which a laundry inlet for putting in or taking out laundry is provided to face the top or a front-loading washing machine in which a laundry inlet is provided to face the front. A washing machine according to various embodiments may include a washing machine of another loading method other than a top-loading washing machine and a front-loading washing machine.

In the case of a top-loading washing machine, laundry may be washed using a water current occurred by a rotating body such as a pulsator. In the case of a front-loading washing machine, laundry may be washed by rotating a drum to repeatedly raise and drop the laundry. A front-loading washing machine may include a drying coupled washing machine capable of drying laundry accommodated inside the drum. A drying coupled washing machine may include a hot air supply device for supplying high-temperature air into the drum and a condensing device for removing moisture from air discharged from the drum. For example, a drying coupled washing machine may include a heat pump device. A washing machine according to various embodiments may include a washing machine using a washing method other than the above-described washing method.

A washing machine according to various embodiments may include a housing accommodating various components therein. The housing may be provided in the form of a box with a laundry inlet formed on one side thereof.

A washing machine may include a door for opening and closing the laundry inlet. The door may be rotatably mounted on the housing by hinges. At least a portion of the door may be transparent or translucent such that the inside of the housing is visible.

A washing machine may include a tub provided inside the housing to store water. The tub may be provided in a substantially cylindrical shape with a tub opening formed on one side thereof, and may be disposed inside the housing such that the tub opening is disposed to correspond to the laundry inlet.

The tub may be connected to the housing by a damper. The damper may absorb vibration that occurs when the drum rotates to attenuate the vibration to be transmitted to the housing.

A washing machine may include a drum provided to accommodate laundry.

The drum may be disposed inside the tub such that a drum opening provided on one side thereof corresponds to the laundry inlet and the tub opening. Laundry may sequentially pass through the laundry inlet, tub opening, and drum opening to be put into the drum or taken out from the drum.

The drum may perform each operation according to a washing, rinsing, and/or dewatering process while rotating inside the tub. A plurality of through holes is formed on a cylindrical wall of the drum such that water stored in the tub may flow into or out of the drum.

A washing machine may include a driving device configured to rotate the drum. The driving device may include a driving motor and a rotating shaft for transmitting a driving force generated by the driving motor to the drum. The rotating shaft may penetrate the tub to be connected to the drum.

The driving device may rotate the drum forward or backward to perform each operation according to the washing, rinsing, and/or dewatering, or drying process.

A washing machine may include a water supply device configured to supply water to the tub. The water supply device may include a water supply pipe and a water supply valve provided in the water supply pipe. The water supply pipe may be connected to an external water supply source. The water supply pipe may extend from the external water supply source to a detergent supply device and/or the tub. Water may be supplied to the tub through the detergent supply device. Water may be supplied to the tub without passing through the detergent supply device.

The water supply valve may open or close the water supply pipe in response to an electrical signal from a controller. The water supply valve may allow or block water to be or from being supplied to the tub from the external water supply source. The water supply valve may include, for example, a solenoid valve that is opened and closed in response to the electrical signal.

A washing machine may include a detergent supply device configured to supply a detergent to the tub. The detergent supply device may include a manual detergent supply device configured such that a user supplies the detergent to be used each time washing, and an automatic detergent supply device configured to store a large amount of detergent and automatically supply a predetermined amount of detergent each time washing. The detergent supply device may include a detergent box for storing the detergent. The detergent supply device may be configured to supply the detergent into the tub in a water supply process. Water supplied through the water supply pipe may be mixed with the detergent by passing through the detergent supply device. The water mixed with the detergent may be supplied into the inside of the tub. The detergent may be used as a term encompassing a detergent for pre-washing, a detergent for main washing, a fabric softener, a bleaching agent, etc., and the detergent box may be divided into a detergent storage region for pre-washing, a detergent storage region for main washing, a fabric softener storage region, and a bleaching agent storage region.

A washing machine may include a drainage device configured to discharge water accommodated in the tub to the outside. The drainage device may include a drain pipe extending from a lower end of the tub to the outside of the housing, a drain valve provided on the drain pipe to open and close the drain pipe, and a pump provided on the drain pipe. The pump may pump water in the drain pipe to the outside of the housing.

A washing machine may include a control panel disposed on one surface of the housing. The control panel may provide a user interface for interaction between the user and the washing machine. The user interface may include at least one input interface and at least one output interface.

The at least one input interface may convert sensory information received from the user into an electrical signal.

The at least one input interface may include a power button, an operation button, a course selection dial (or course selection button), and washing/rinsing/dewatering setting buttons. The at least one input interface may include, for example, a tact switch, a push switch, a slide switch, a toggle switch, a micro switch, a touch switch, a touch pad, a touch screen, a jog dial, and/or a microphone, etc.

The at least one output interface may visually or auditorily deliver information related to operations of the washing machine to the user.

For example, the at least one output interface may deliver information related to a washing course, operating time of the washing machine, and washing setting/rinsing setting/dewatering setting to the user. The information about the operations of the washing machine may be output through a screen, an indicator, a voice, etc. The at least one output interface may include, for example, a liquid crystal display (LCD) panel, a light emitting diode (LED) panel, a speaker, etc.

A washing machine may include a communication module for wired and/or wireless communication with an external device.

The communication module may include at least one of a short-range communication module and a long-distance communication module.

The communication module may transmit data to or receive data from an external device (e.g., server, user device, and/or home appliance). For example, the communication module may establish communication with a server and/or a user device and/or a home appliance, and transmit and receive various data.

To this end, the communication module may support establishment of a direct (e.g., wired) communication channel or wireless communication channel between external devices, and performance of communication through the established communication channel. According to an embodiment, the communication module may include a wireless communication module (e.g., a cellular communication module, a short-range wireless communication module, or a global navigation satellite system (GNSS) communication module), or a wired communication module (e.g., a local area network (LAN) communication module, or a power line communication module). Among these communication modules, the corresponding communication module may communicate with an external device through the first network (e.g., a local area network such as Bluetooth, wireless fidelity (Wi-Fi) direct, or infrared data association (IrDA)) or the second network (e.g., a legacy cellular network, a 5G network, a next-generation communications network, the Internet, or a telecommunications network such as a computer network (e.g., LAN or WAN)). These various types of communication modules may be integrated into one component (e.g., a single chip) or may be implemented as a plurality of separate components (e.g., multiple chips).

The short-range wireless communication module may include, but is not limited thereto, a Bluetooth communication module, a Bluetooth low energy (BLE) communication module, a near field communication module, a WLAN (Wi-Fi) communication module, a ZigBee communication module, an infrared data association (IrDA) communication module, a Wi-Fi direct (WFD) communication module, an ultra-wideband (UWB) communication module, an Ant+ communication module, microwave (U-wave) communication module, etc.

The long-distance communication module may include a communication module performing various types of long-distance communication and may include a mobile communication device. The mobile communication device transmits and receives wireless signals to and from at least one of a base station, an external terminal, and a server on a mobile communication network.

In an embodiment, the communication module may communicate with external devices such as a server, a user device, and another home appliance through a nearby access point (AP). The access point (AP) may connect the local area network (LAN) to which a washing machine or a user device is connected to a wide area network (WAN) to which a server is connected. The washing machine or the user device may be connected to the server via the wide area network (WAN). The controller may control various components of the washing machine (e.g., the driving motor and water supply valve). The controller may control various components of the washing machine to perform at least one process including water supply, washing, rinsing, and/or dewatering according to user input. For example, the controller may control the driving motor to regulate a rotational speed of the drum, or control the water supply valve of the water supply device to supply water to the tub.

The controller may include hardware such as a CPU or memory, and software such as a control program. For example, the controller may include an algorithm for controlling operations of components in a washing machine, at least one memory storing data in the form of a program, and at least one processor performing the operations using data stored in the at least one memory. The memory and processor may each be implemented as a separate chip. The processor may include one or two or more processor chips or one or two or more processing cores. The memory may include one or two or more memory chips or one or two or more memory blocks. The memory and processor may be implemented as a single chip.

Hereinafter, a clothes treating apparatus according to various embodiments will be described in detail with reference to the accompanying drawings. Hereinafter, a washing machine is described as an example of a clothes treating apparatus, but the present disclosure is not limited to a washing machine and may be applied to various devices for treating and/or managing clothes.

Figure 2:
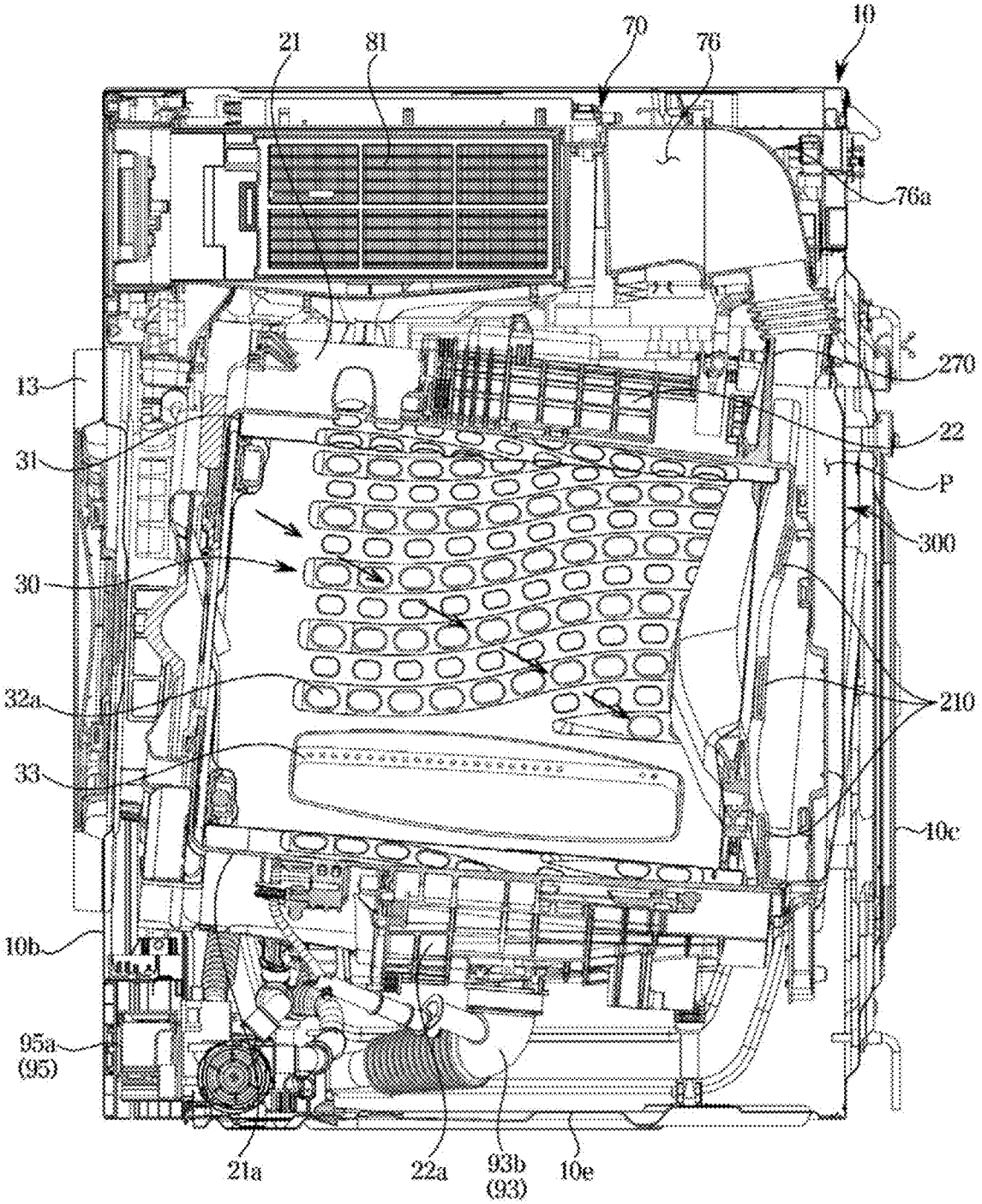
FIG. 2 illustrates a cross-section of a clothes treating apparatus according to an embodiment of the present disclosure.
Figure 3:
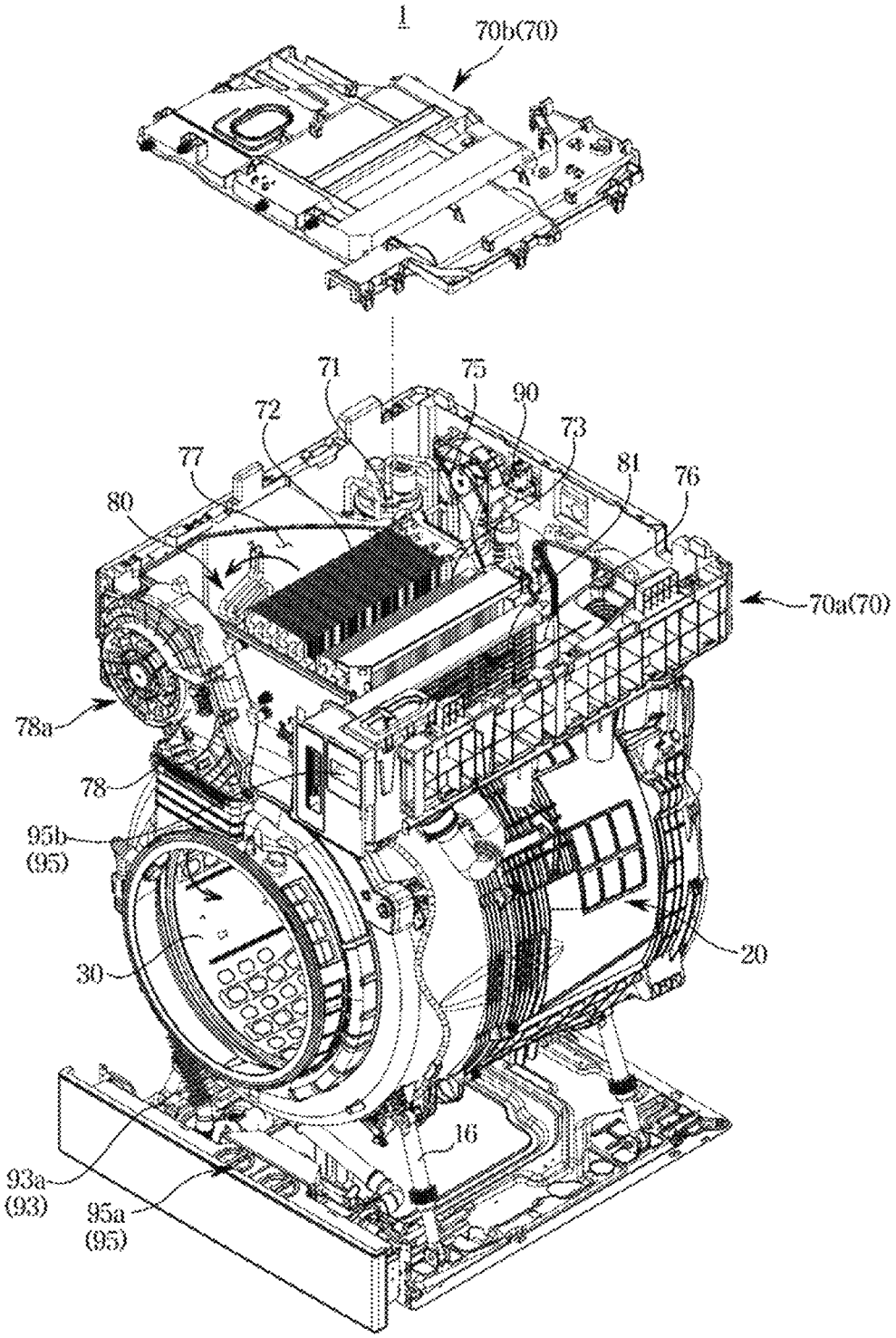
FIG. 3 illustrates a part of a configuration arranged inside a clothes treating apparatus according to an embodiment of the present disclosure.
Figure 4:
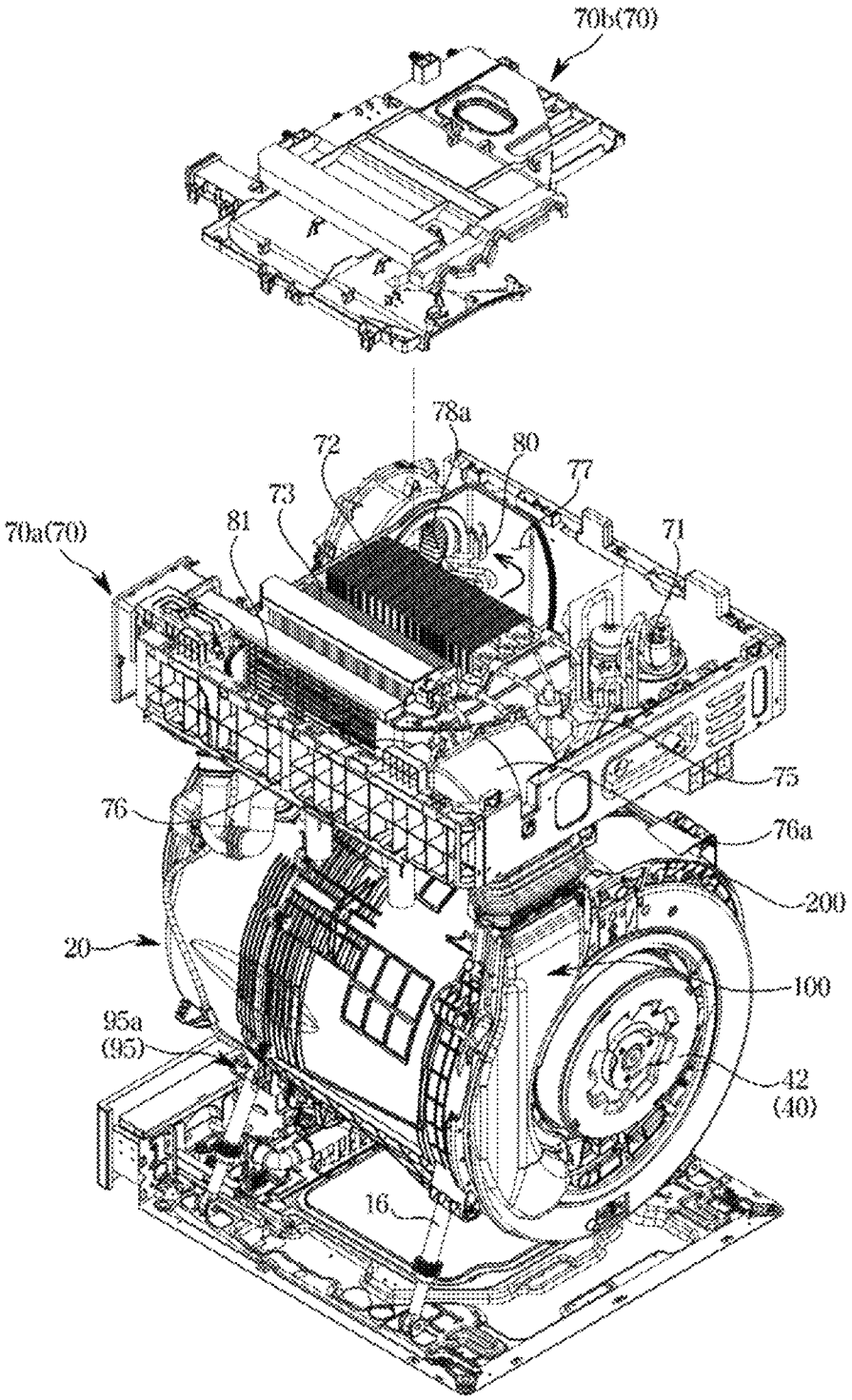
FIG. 4 illustrates a part of a configuration arranged inside a clothes treating apparatus according to an embodiment of the present disclosure, which is viewed in a direction different from a direction shown in FIG. 3.
Figure 5:
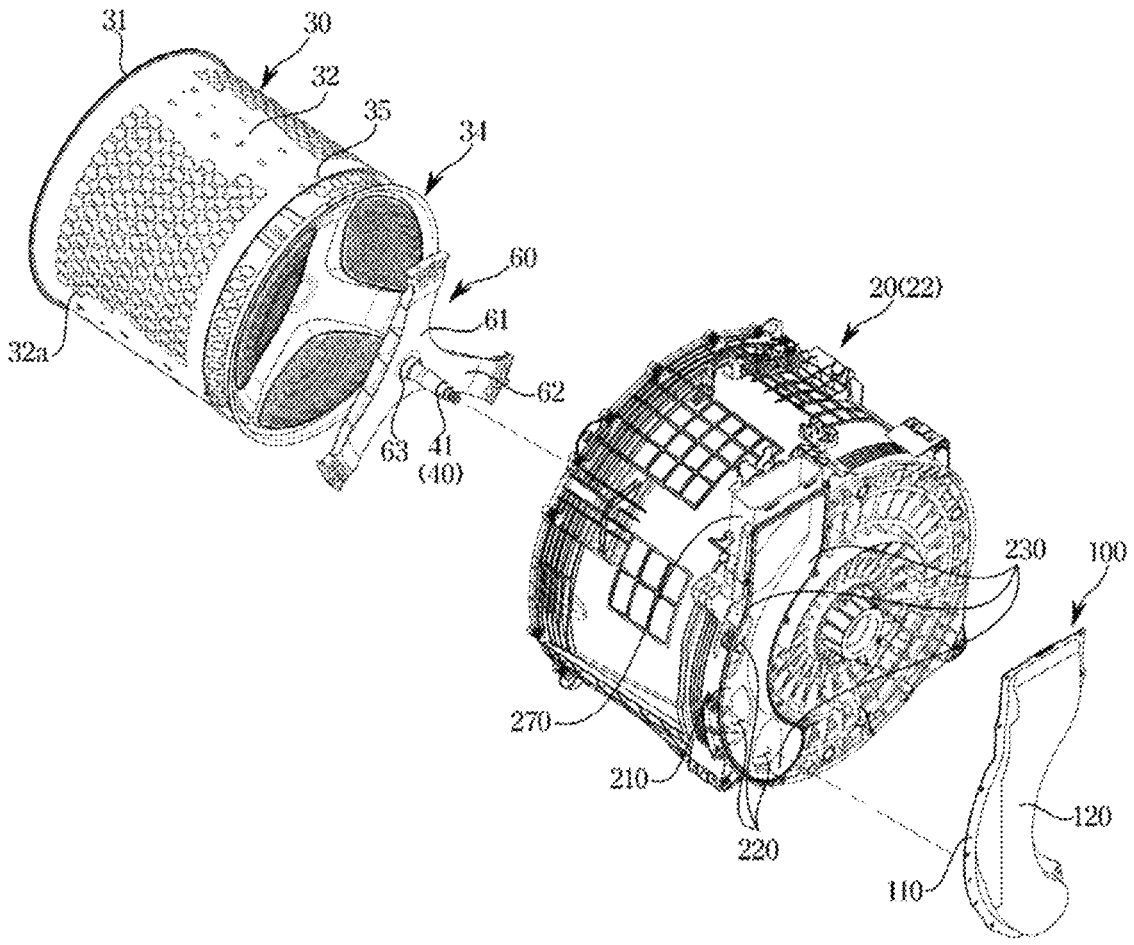
FIG. 5 is an exploded view illustrating some components a clothes treating apparatus according to an embodiment of the present disclosure.

FIG. 1 is a perspective view illustrating a clothes treating apparatus according to an embodiment of the present disclosure. FIG. 2 illustrates a cross-section of a clothes treating apparatus according to an embodiment of the present disclosure. FIG. 3 illustrates a part of a configuration arranged inside a clothes treating apparatus according to an embodiment of the present disclosure. FIG. 4 illustrates a part of a configuration arranged inside a clothes treating apparatus according to an embodiment of the present disclosure, which is viewed in a direction different from a direction shown in FIG. 3. FIG. 5 is an exploded view illustrating some components a clothes treating apparatus according to an embodiment of the present disclosure.

Referring to FIGS. 1 to 5, a clothes treating apparatus according to an embodiment of the present disclosure may be a washer-dryer combo. The clothing treating apparatus 1 includes a housing 10 forming the external appearance thereof, a tub 20 accommodating water to be used for a washing process or a rinsing process, a drum 30 accommodating laundry, and a driving device 40 provided to rotate the drum 30.

The housing 10 may be provided in an approximately hexahedral shape. In other words, the housing 10 may be provided in a box shape. The housing 10 includes frames 10*a*, 10*b*, 10*c*, 10*d*, and 10*e*, and the frames 10*a*, 10*b*, 10*c*, 10*d*, and 10*e* may include an upper frame 10*a* forming the upper surface of the housing 10, a front frame 10*b* and a rear frame 10*c* forming the front and rear surfaces of the housing 10, and a side frame 10*d* and a lower frame 10*e*) connecting the front frame 10*b* and the rear frame 10*c* and forming the side surface and the lower surface of the housing 10.

The front frame 10*b* of the housing 10 may include a laundry inlet 14 configured to introduce or withdrawn laundry into or from the drum 30. The laundry inlet 14 may be opened and closed by a door 13 installed in the front frame 10*b* of the housing 10.

The clothes treating apparatus 1 may include the door 13 for opening and closing the laundry inlet 14. The door 13 may be rotatably mounted to the housing 10 by a hinge. At least a portion of the door 13 may be provided to be transparent or translucent such that the inside of the housing 10 may be visible. For example, the door 13 may include tempered glass.

The clothes treating apparatus 1 may include a lower door 18 configured to allow access to a lower detergent supply device 95*a*. The clothes treating apparatus 1 may include an upper door 19 configured to allow access to an upper detergent supply device 95*b* and a filter 81.

Provided in an upper portion of the front frame 10*b* of the housing 10 is a control panel 11 for controlling the operation of the clothes treating apparatus 1. The control panel 11 may provide a user interface for interaction between a user and the clothes treating apparatus 1. The control panel 11 may be provided with an input device for receiving g an input regarding the operation of the clothes treating apparatus 1, and a display for showing various types of information regarding the clothes treating apparatus 1. For example, the control panel 11 may include a display panel that allows touch input. However, it is not limited thereto, and the control panel may include various types of input devices and displays.

The clothes treating apparatus 1 may include a tub 20 provided inside the housing 10 to store water. The tub 20 may be provided in a substantially approximately cylindrical shape with a tub opening 21 formed at one side thereof, and may be arranged inside the housing 10 such that the tub opening 21 corresponds to the laundry inlet 14. The tub opening 21 may be provided to face approximately forward.

The tub 20 may include a tub body 22*a* corresponding to the side surface of the cylinder. The tub body 22*a* may be provided in a cylindrical shape with the front and rear sides each open. On the open front side of the tub body 22*a*, a tub front of the tub 20 in which the tub opening 21 is formed may be provided. Since the tub front of the tub 20 covers a part of the open front side of the tub body 22*a*, the tub opening 21 may be provided to be smaller than the open front side of the tub body 22*a*. A tub back 200 may be provided on the open rear side of the tub body 22*a*. The tub back 200 may be provided to cover the open rear side of the tub body 22*a*. The tub back 200 may be provided to correspond in size and shape to the open rear side of the tub body 22*a* to cover the open rear side of the tub body 22*a*.

The tub 20 may be connected to the housing 10 by a damper 16. The damper 16 may absorb vibrations generated when the drum 30 rotates and attenuate vibrations transmitted to the housing 10.

The clothing treating apparatus 1 may include a drum 30 provided to accommodate laundry. The drum 30 may be provided in a cylindrical shape. The drum 30 may be provided inside the housing 10. The drum 30 may be provided to be rotatable by receiving power from a driving device 40.

The drum 30 may perform each operation according to washing, rinsing, and/or spin-drying processes while rotating inside the tub 20. A plurality of through holes 32*a* may be formed in a cylindrical wall of the drum 30 to allow water stored in the tub 20 to be introduced into the drum 30 or water in the drum 30 to be discharged from the drum 30.

The clothes treating apparatus 1 may include a water supply device 40 configured to supply water to the tub 20. The water supply device 90 may be arranged at the upper side of the tub 20. The water supply device 90 may be arranged at the rear of the drying device 70.

The clothes treating apparatus 1 may include a detergent supply device 95 for supplying detergent to the tub 20. The detergent supply device 95 may include an upper detergent supply device 95*b* and a lower detergent supply device 95*a*. The upper detergent supply device 95*b* may be arranged at the upper side of the tub 20. The lower detergent supply device 95*a* may be arranged at the lower side of the tub 20. Detergent is used as a term including detergent for pre-washing, detergent for main washing, fabric softener, bleach, etc.

The clothing treating apparatus 1 may include a drainage device 93 configured to discharge water contained in the tub 20 to the outside. The drainage device 93 may be arranged at the lower side of the tub 20. The drainage device 93 may include a drainage pump 93*a* for discharging water in the tub 20 to the outside of the housing 10, a connection hose 93*b* for connecting the tub 20 and the drainage pump 93*a* such that water inside the tub 20 may flow into the drainage pump 93*a*, and a drainage hose for guiding the water pumped by the drainage pump 93*a* to the outside of the housing 10.

The tub 20 may be supported by a damper 16. The damper 16 may connect the lower frame 10*e*) of the housing 10 and the outer surface of the tub 20. The damper 16 may be located on the upper side, left and right sides of the housing 10 in addition to the lower frame to support the tub 20.

The drum 30 may include a drum body 32, a drum front 31, and a drum back 34.

The drum body 32 may be formed into a hollow cylindrical shape with the front and rear ends thereof open. A plurality of through holes 32*a* are formed in the cylindrical drum body 32 such that water stored in the tub 20 may be introduced into the drum 30 or water may be discharged to be outside of the drum 30. At least one lifter 33 may be installed on the inner surface of the drum body 32 such that laundry may rise and fall when the drum 30 rotates.

The drum front 31 may be arranged at the front end of the drum body 32, and the drum back 34 may be arranged at the rear end of the drum body 32.

The drum body 32 may be provided on the side surface thereof with a coupling hole 35. The drum body 32 may be provided at the rear end thereof with a coupling hole 35 to which the drum back 34 may be coupled. The coupling holes 35 may be formed in plural. The coupling hole 35 is provided to fix a flange shaft 60 installed on the drum back 34. The coupling hole 35 may be formed to correspond to the flange shaft 60. The coupling holes 35 may be formed at certain intervals along the circumference of the drum body 32 to correspond to the flange shaft 60.

The drum front 31 may be provided to correspond to a front end opening of the drum body 32. The drum back 34 may be provided to correspond to a rear end opening of the drum body 32.

The drum back 34 may be formed in a disc shape to block the rear end opening of the drum body 32. In the embodiment of the present disclosure, the drum back 24 may be formed with a plurality of through holes that allow air to flow effectively from the inside of the drum to the outside.

The clothing treating apparatus 1 may include a driving device 40 provided to rotate the drum 30. The driving device 40 may include a driving motor 42 and a rotating shaft 41 connected to the drum 30 to transmit the driving force generated from the driving motor 42 to the drum 30. The rotating shaft 41 for transmitting the power of the driving motor 42 is connected to the drum back 34 of the drum 30. The drum 30 is rotated within the tub 20 by the rotary force transmitted through the rotating shaft 41.

The driving motor 42 may be provided on the outside of the tub 20. The driving motor 42 may be connected to the drum 30 through the rotating shaft 41. The rotating shaft 41 penetrates the tub back 200 of the tub 20 and is rotatably supported by bearings 52 and a reinforcing bracket 100.

The driving motor 42 may include a stator fixed to the outside of the tub back 200 and a rotor that is rotatably provided and connected to the rotating shaft 41. The stator may electromagnetically interact with the rotor to convert rotational electric power into mechanical rotational power. The rotation of the rotor may be transmitted to the drum 30 through the rotating shaft 41.

The drum back 34 may be connected to the rotating shaft 41 through the flange shaft 60. The flange shaft 60 may be provided to transmit the power of the driving motor 42.

The flange shaft 60 may include a hub portion 61 arranged at the center of the drum back 34 and a plurality of flange portions 62 extending radially from the hub portion 61. The hub portion 61 may be provided at the center thereof with a shaft coupling portion 63 for installing the rotating shaft 41.

The plurality of flange portions 62 may be formed at approximately 120-degree intervals centered on the hub portion 61. The plurality of flange portions 62 may be formed to correspond to the diameter of the drum back 34. Each of the flange portions 62 may be provided at one end thereof with a plurality of fastening holes 64. The plurality of fastening holes 64 may be formed to correspond to the coupling holes 35 of the drum 30. In the embodiment of the present disclosure, one flange portion is illustrated as including two fastening holes, but the spirit of the present disclosure is not limited thereto. For example, the fastening holes may be provided in various numbers and arrangements depending on the size and shape of the drum and the flange portion.

The rotating shaft 41 is arranged between the drum 30 and the driving motor 42. One end of the rotating shaft 41 is connected to the drum back 34, and the other end of the rotating shaft 41 extends to the outside of the tub back 200. When the driving motor 42 rotates the rotating shaft 41, the drum 30 connected to the rotating shaft 41 rotates around the rotating shaft 41.

On the tub back 200, a reinforcing bracket 100 that rotatably supports the rotating shaft 41 may be provided. The reinforcing bracket 100 may be formed of an aluminum alloy. For example, the reinforcing bracket 100 may be formed through aluminum die casting (ALDC). However, the present disclosure is not limited thereto, and the reinforcing bracket 100 may be formed of stainless steel. The reinforcing bracket 100 may be formed of other types of material as long as it can include a material having a higher strength than the material forming the tub 20.

The reinforcing bracket 100 may be inserted into the tub back 200 when insert-molding the tub 20. More specifically, the tub 20 may be formed by inserting the reinforcing bracket 100 into a mold (not shown) for forming the tub 20 and then injecting a molten resin into the mold. With such a configuration, the tub 20 with the reinforcing bracket 100 inserted into the tub back 200 may be integrally formed.

Between the reinforcing bracket 100 and the rotating shaft 41, bearings 52 may be installed such that the rotating shaft 41 may rotate smoothly.

The clothing treating apparatus 1 may include the drying device 70 for drying laundry accommodated inside the drum 30. The drying device 70 may be provided to heat air and supply the heated air to the inside of the tub 20. The drying device 70 may be configured to dry and heat air discharged from the tub 20 and circulate the dried and heated air into the inside of the tub 20 to dry clothes inside the drum 30. The drying device 70 according to various embodiments may be arranged on the upper side of the tub 20.

The drying device 70 may include a drying case 70*a* in which a heat pump may be installed. The drying case 70*a* may include a drying base 70*b* and a drying cover 70*c* that is coupled to the drying base 70*b* to form a flow path through which air may move. The drying cover 70*c* may cover an open upper surface of the drying base 70*b*.

The drying device 70 according to various embodiments may be configured as a heat pump type drying device. The drying device 70 may include a compressor 71, a condenser 72, an evaporator 73, an expansion valve, and a refrigerant pipe 75 for circulating a refrigerant and exchanging heat. The compressor 71, the condenser 72, the evaporator 73, and the like that constitute the heat pump may be arranged in the drying case 70*a*. For example, the drying device 70 may be mounted in a clothing treating apparatus 1 as a single module.

The compressor 71 may compress the refrigerant, and the compressed high-temperature, high-pressure refrigerant may be moved to the condenser 72. The condenser 72 may cool the refrigerant and heat the surrounding air. The heated air may be introduced into the drum 30 to dry the laundry.

The refrigerant that has expanded through the expansion valve may absorb heat from the evaporator 73 and cool the surrounding air. That is, the evaporator 73 may cool the high-temperature and humidity air that has passed through the drum 30, to remove moisture from the air. The air from which moisture has been removed passes through the condenser 72, by which the air may be re-heated through heat-exchange with the refrigerant in the condenser 72. That is, the condenser 72 may heat the air that has passed through the evaporator 73. The condenser 72 and the evaporator 73 may be referred to as a heat exchanger.

In addition, the drying device 70 may further include a heater 80 in addition to the heat pump to increase the drying efficiency. The present disclosure is not limited thereto, and the drying device 70 may include only the heat pump or only the heater 80.

The heater 80 may heat the air introduced into the drying device 70. The heater 80 may be disposed in a heating path 77. The heater 80 may be disposed downstream of the condenser 72. In addition, the heater 80 may be provided in a relatively small size to minimize the flow path resistance. For example, the heater 80 may be a sheath heater.

The drying device 70 may be formed with an inlet path 76 into which air is introduced from the tub 20. The drying device 70 may be formed with a heating path 77 configured to heat-exchange air introduced into the drying device 70 through the inlet path 76. The drying device 70 may be formed with a supply path 78 configured to supply the tub 20 with the air having heat exchanged while passing through the heating path 77.

The inlet path 76 is provided to allow air passed through the inside of the tub 20 to enter the drying device 70. The inlet path 76 may be located on the upper side of the tub 20. The inlet path 76 may communicate with an exhaust path P formed at the rear of the tub 20.

The drying device 70 may include an inlet guide 76*a* connected to the tub 20. The inlet guide 76*a* may guide air discharged from the tub 20 to the inlet path 76. The inlet path 76 may be connected to the exhaust path P formed in the tub 20 through the inlet guide 76*a*. Air passed through the exhaust path P may be introduced into the inlet path 76 of the drying device 70 through the inlet guide 76*a*.

The inlet path 76 may be provided with a filter 81 configured to filter out foreign substances, such as lint contained in air introduced through the exhaust path P from the tub 20. The air introduced into the inlet path 76 may pass through the filter 81 and flow into the heating path 77.

The condenser 72 and the evaporator 73 may be arranged in the heating path 77. Since the introduced air has become hot and humid by passing through the inside of the tub 20, the hot and humid air may be cooled in the evaporator 73 arranged in the heating path 77 so that moisture is removed. Thereafter, the air may be repeatedly heated by passing through the condenser 72.

The supply path 78 may supply the air heated by passing through the condenser 72 back into the tub 20. The supply path 78 may communicate with the heating path 77 and may extend downward to discharge heated air toward the opening of the tub 20.

The drying device 70 may include a blower fan 78*a*) for allowing air to flow into the tub 20. In an embodiment, the blower fan 78*a*) may be disposed in the supply path 78. The blower fan 78*a*) may allow air of the heating path 77 and the supply path 78 to be supplied to the inside of the drum 30. For example, the blower fan 78*a*) may include a sirocco fan.

The supply path 78 may extend approximately vertically from a front end portion of the drying base 70*b* toward the tub 20. The front end portion of the drying base 70*b* may refer to an area adjacent to the front end of the drying base 70*b*. The supply path 78 may extend downward from the front end portion of the drying base 70*b*, which is located on the upper side of the tub 20, toward the tub 20.

According to an embodiment, the clothes treating apparatus 1 may have the supply path 78 directly extended downward from the front end portion of the drying base 70*b* toward the tub 20 rather than being extended forward of the front end portion of the drying base 70*b* and then extended toward the tub 20. As a result, there is no need to secure a gap between the front frame 10*b* of the housing 10 and the front of the tub 20 to form the supply path 78. In other words, the clothes treating apparatus 1 may minimize or prevent an increase in size in the front-back direction to secure the supply path 78.

The clothes treating apparatus 1 may include an exhaust path P for allowing air discharged from the tub 20 to flow to the drying device 70. The exhaust path P may be connected to the inlet path 76 of the drying device 70.

The exhaust path P may be provided to allow moist air discharged from the inside of the drum 30 to the tub 20 to be discharged to the outside of the tub 20. For example, the exhaust path P may be provided at the rear of the tub 20.

The exhaust path P, the inlet path 76, the heating path 77, and the supply path 78 may circulate air between the inside of the tub 20 and the drying device 70.

According to an embodiment of the present disclosure, a clothing treating apparatus 1 may be arranged such that air discharged to the rear of a tub 20 is introduced into the inlet path 76 of the drying device 70 located on the upper side the tub 20 through the exhaust path P, and then sequentially passes through the heating path 77 and the supply path 78, finally flowing back into the tub 20.

The tub back 200 may be provided with a tub exhaust port 220 such that air inside the tub 20 is discharged to the rear side of the tub 20. The air discharged through the tub exhaust port 220 may flow along the exhaust path P to the inlet path 76.

In the clothing treating apparatus 1 according to an embodiment, the exhaust path P may be formed by coupling a duct cover 300 to the tub back 200. The exhaust path P may be formed by coupling the duct cover 300 to a tub duct 213, which will be described below.

The tub 20 according to an embodiment may include a reinforcing rib 201 formed on the rear surface of the tub back 200 and a tub duct 213 formed on the rear surface of the tub back 200. The front surface of the tub back 200 may refer to one surface of the tub back 200 arranged on the inside of the tub 20, and the rear surface of the tub back 200 may refer to the other surface of the tub back 200 arranged on the outside of the tub 20.

The reinforcing rib 201 may be formed to reinforce the rigidity of the tub back 200. The reinforcing rib 201 may protrude rearward from the rear surface of the tub back 200.

The tub duct 213 may include a recessed portion 210 and a partition rib 230. The recessed portion 210 may be formed in the vicinity of the tub exhaust port 220 and may refer to a portion in which the reinforcing rib 201 is not formed or a portion that is recessed forward than the rear end of the reinforcing rib 201. The partition rib 230 may refer to a protruding portion formed along the periphery of the recessed portion 210. The partition rib 230 may protrude from the edge of the recessed portion 210 to the rear side of the tub back 200. The partition rib 230 may form a sidewall of the exhaust path P.

Air heated in the drying device 70 may be introduced into the tub 20 and then supplied into the drum 30. In this case, it is required to secure an area in which the heated air supplied into the drum 30 comes into contact with the laundry. The longer the distance and time that the heated air flows inside the drum 30, the more the air may come into contact with the laundry. To this end, the tub exhaust port 220 may be formed at a position opposite to an air inlet 26 through which heated air from the drying device 70 enters the tub 20.

The air inlet 26 through which heated air from the drying device 70 enters the tub 20 and the tub exhaust port 220 through which air inside the tub 20 is discharged may be positioned as far as possible. To this end, the air inlet 26 and the tub exhaust port 220 may be positioned diagonally when the tub 20 is viewed from the front or rear.

For example, when the air inlet 26 is formed at the upper right front of the tub 20 or at a position adjacent to the upper right front of the tub 20, the tub exhaust port 220 may be formed at the lower left of the tub back 200 or at a position adjacent to the lower left of the tub back 200. In this case, since the heated air moves from the upper right front of the tub 20 toward the lower left of the tub back 200, which may allow the heated air to also move in a similar direction even inside the drum 30 that is arranged inside the tub 20. That is, the heated air may move in a diagonal direction from the upper right front of the drum 30 toward the lower rear left of the drum 30. With such a configuration, the movement path of the heated air inside the drum 30 may be formed as long as possible. As the movement path of the heated air increases, the heated air may come into contact with the laundry inside the drum 30 over a larger area for a long time, thereby improving the drying efficiency of the clothing treating apparatus 1.

However, the present disclosure is not limited thereto, and the air inlet 26 and the tub exhaust port 220 may be provided at different locations depending on the areas of the air inlet 26 and the tub exhaust port 220 and/or the air volume of the blower fan 78*a*.

The clothing treating apparatus 1 may include the duct cover 300 coupled to the tub 20 to cover the tub duct 213.

The exhaust path P may be formed by an open side of the tub duct 213 being covered with the duct cover 300. When the duct cover 300 is coupled to the tub 20, the exhaust path P may be formed by the recessed portion 210, the partition rib 230, and the duct cover 300. The exhaust path P may be formed by the duct cover 300 being coupled to the second region R2.

The tub 20 may further include a duct connection portion 270 that protrudes from the tub body 22*a* in a radially outward direction of the tub body 22*a*. For example, the duct connection portion 270 may protrude upward from the rear end of the tub body 22*a*. However, the present disclosure is not limited thereto, and the duct connection portion 270 may be positioned in various forms depending on the location of the drying device 70.

The duct connection portion 270 may connect the inlet guide 76*a* of the drying device 70 to the tub duct 213. The duct connection portion 270 may extend the exhaust path P upward. The duct connection portion 270 may form a part of the exhaust path P together with the recessed portion 210, the partition rib 230, and the duct cover 300.

The duct connection portion 270 may be formed in a rectangular parallelepiped shape with an upper surface and a rear surface that are open. The duct cover 300 may cover the open rear surface of the duct connection portion 270. The duct cover 300 may be coupled while forming only one surface of the exhaust path, which may facilitate implementing the coupling and sealing structure.

The duct cover 300 may cover the tub duct 213 and the duct connection portion 270. The duct cover 300 may cover the open side of the tub duct 213 and the open rear surface of the duct connection portion 270. The exhaust path P may be formed by the duct cover 300 covering the recessed portion 210 and the duct connection portion 270. Since the exhaust path P is connected to the inlet path 76, air introduced into the exhaust path P through the tub exhaust port 220 formed in the tub back 200 may move along the exhaust path P and enter the drying device 70 through the inlet path 76.

Figure 6:
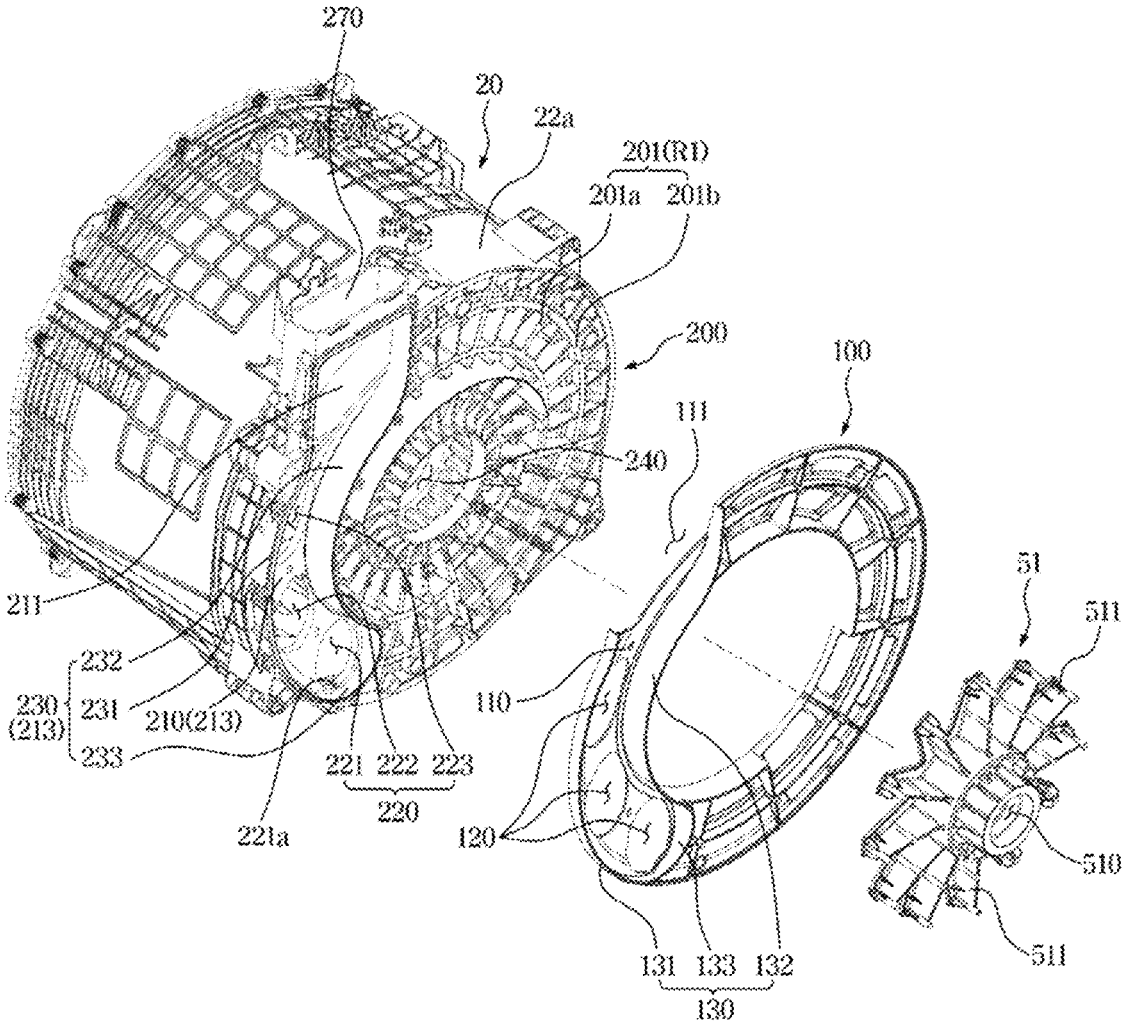
FIG. 6 is a view illustrating a state in which the tub shown in FIG. 5 and a bearing housing and a reinforcing bracket that are inserted into the tub are disassembled.
Figure 7:
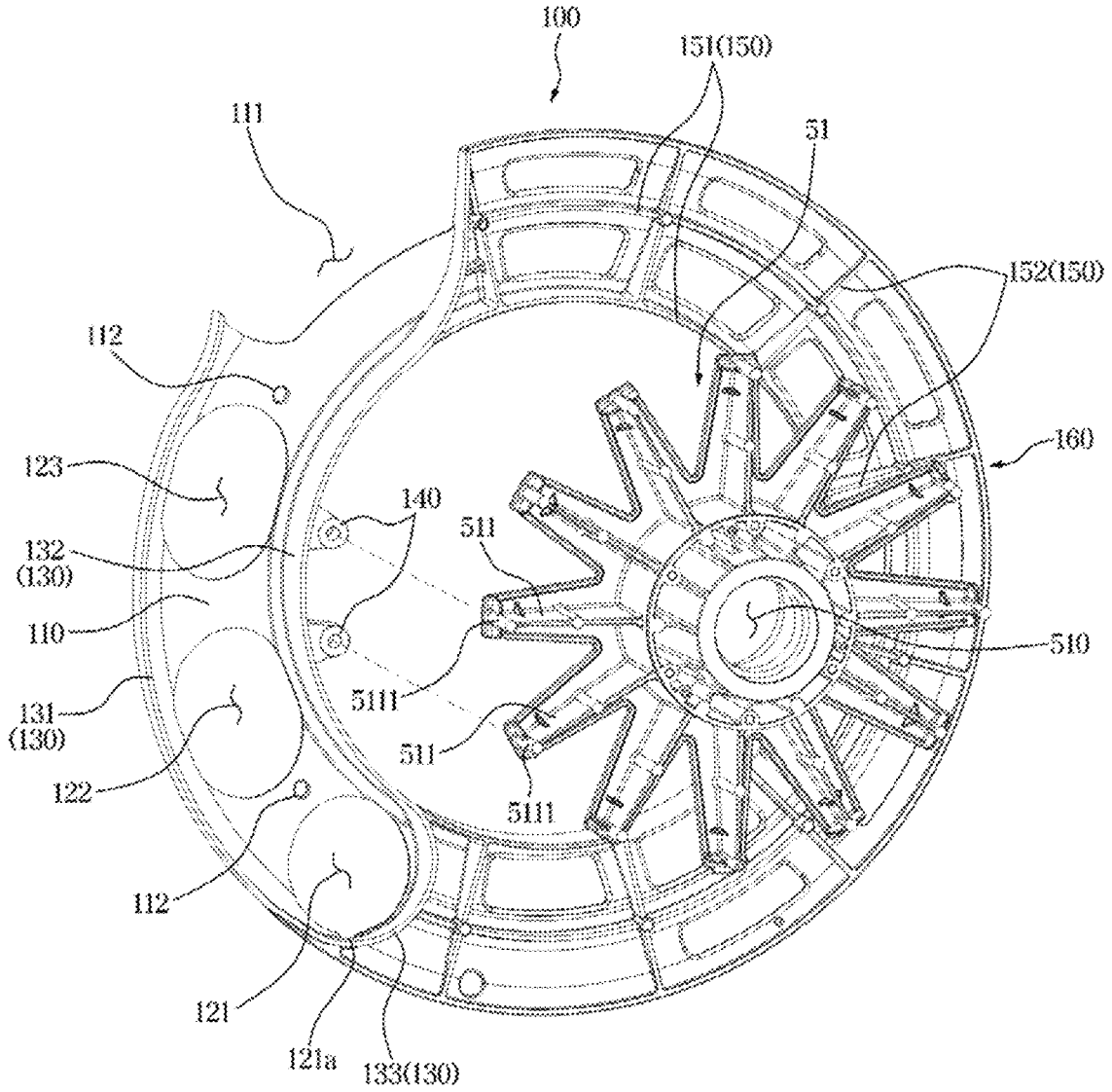
FIG. 7 is a view illustrating the structure of the bearing housing and the reinforcing bracket shown in FIG. 6.
Figure 8:
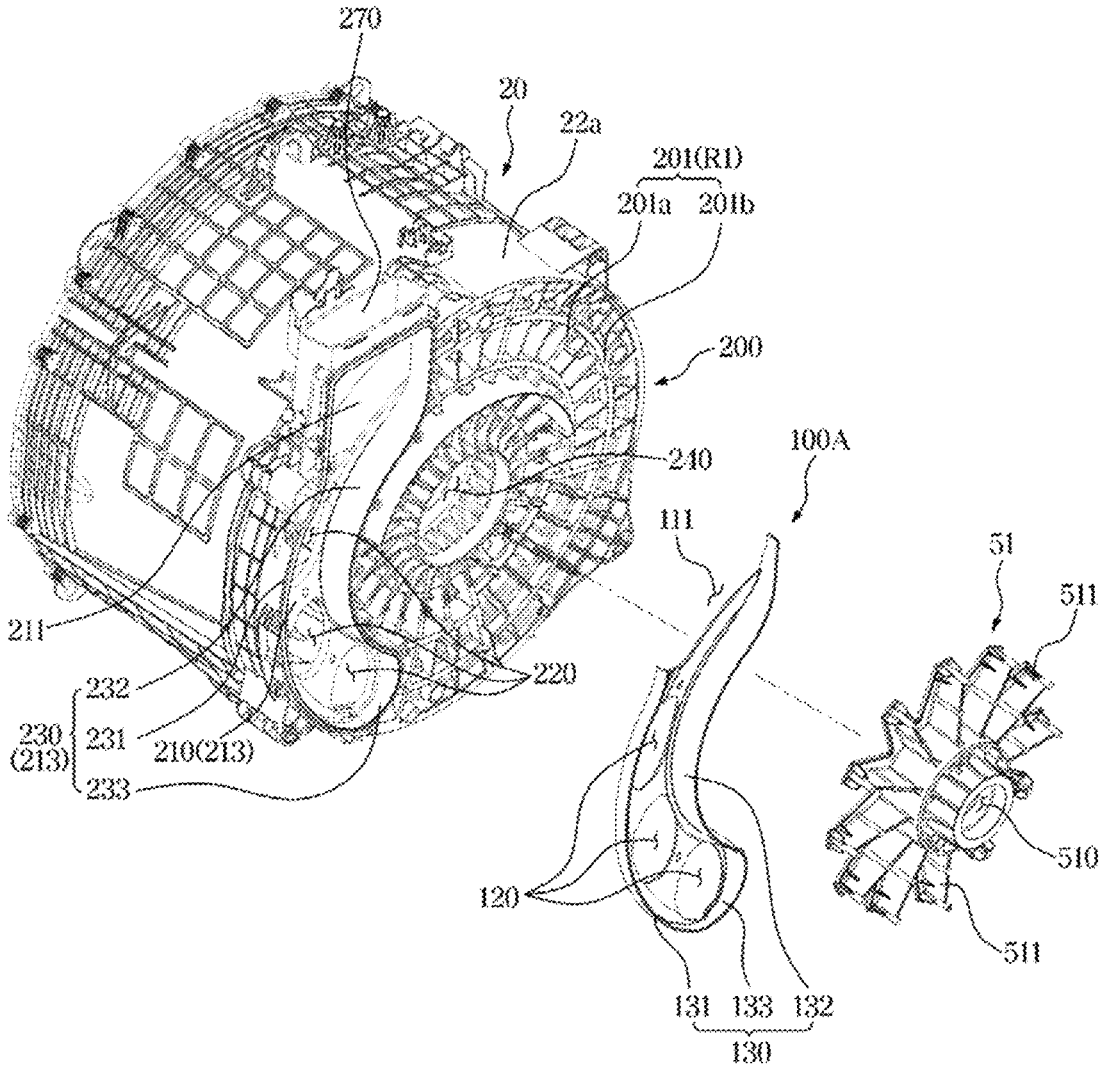
FIG. 8 is an exploded view illustrating a state in which a tub with a reinforcing bracket inserted and a bearing housing are disassembled.
Figure 9:
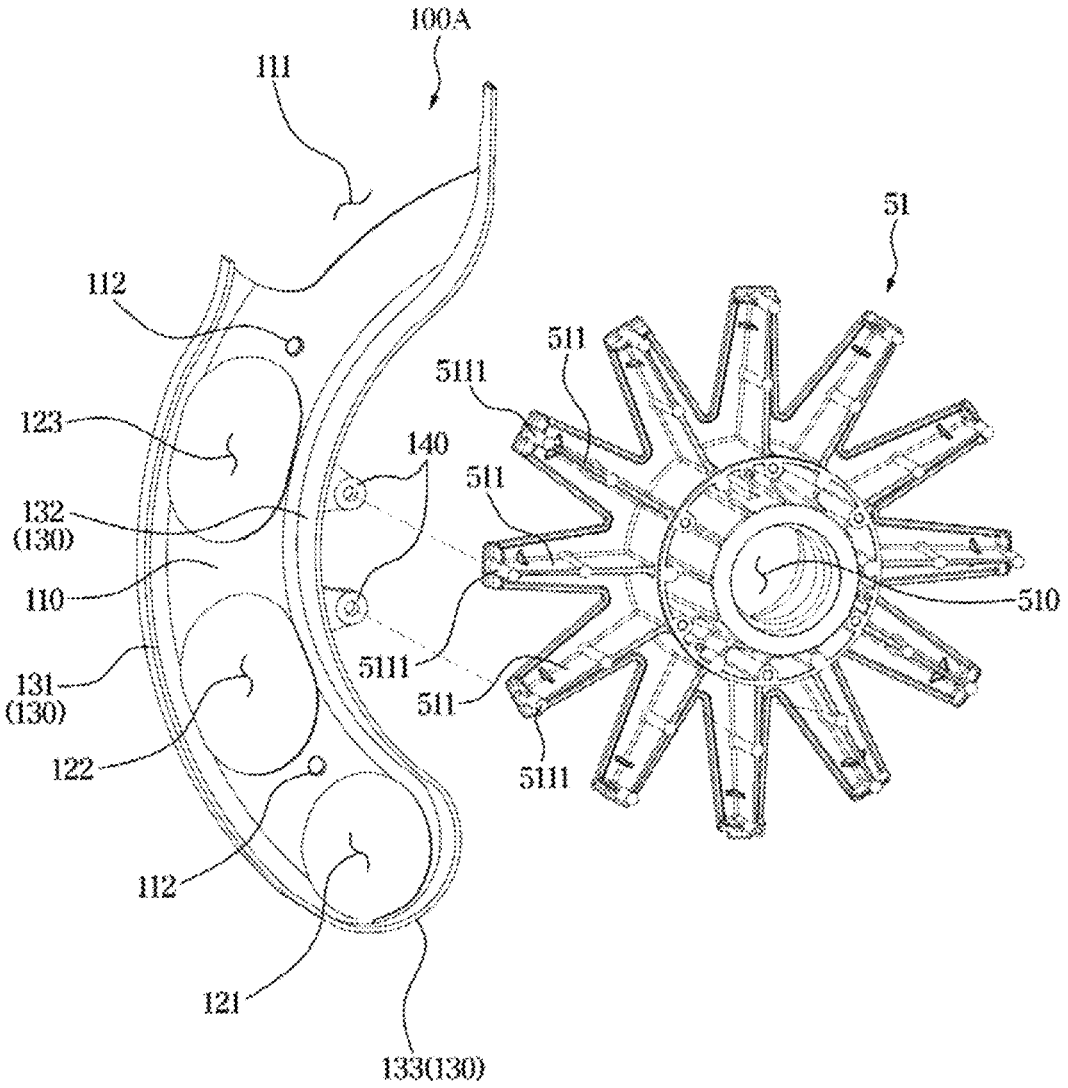
FIG. 9 is a view illustrating the structure of the bearing housing and the reinforcing bracket shown in FIG. 8.

FIG. 6 is a view illustrating a state in which the tub shown in FIG. 5 and a bearing housing and a reinforcing bracket that are inserted into the tub are disassembled. FIG. 7 is a view illustrating the structure of the bearing housing and the reinforcing bracket shown in FIG. 6. FIG. 8 is an exploded view illustrating a state in which the tub with the reinforcing bracket inserted, and the bearing housing are disassembled. FIG. 9 is a view illustrating the structure of the bearing housing and the reinforcing bracket shown in FIG. 8.

Referring to FIGS. 6 to 9, the tub 20 according to an embodiment may include a tub back 200 forming the rear surface of the tub 20.

The tub back 200 may be formed with a plurality of ribs protruding from a disc-shaped structure having a hole in the center. The tub back 200 may be provided in the center thereof with a tub penetration hole 240 through which the rotating shaft 41 penetrates. The tub back 200 may be provided on a lower side thereof with a tub exhaust port 220 that is connected to the exhaust path P.

The tub back 200 may have a first region R1 in which a plurality of reinforcing ribs 201 are formed. The plurality of reinforcing ribs 201 may be provided to reinforce the rigidity of the tub back 200. In the first region R1, a plurality of radial reinforcing ribs 201*a* and a plurality of annular reinforcing ribs 201*b* may be formed.

The tub back 200 may have a second region R2 including a recessed portion 210 configured to form the exhaust path P through which air flows from the tub exhaust port 220. The second region R2 may refer to a region in which the reinforcing rib 201 is not formed or a region protruding less rearward than the reinforcing rib 201.

Heated air supplied to the inside of the tub 20 through the supply path 78 flows into the inside of the drum 30, absorbs the moisture of the laundry contained in the drum 30, becomes humid air, and then is discharged from the drum 30 and the tub 20. In this process, the heated air needs to be spread throughout the inside of the drum 30 such that the moisture of the laundry may be sufficiently removed and the drying efficiency may be improved. To this end, there is a need for a path connecting the front to the rear of the drum 30, and a path design capable of reducing the amount of the heated air discharged through the plurality of through holes 32*a* formed in the cylindrical drum body 32 before reaching the rear of the drum 30. According to the present disclosure, the tub exhaust port 220 may be formed in the tub back 200 to increase the amount of heated air discharged toward the rear of the drum 30.

By forming the tub exhaust port 220 in the tub back 200, heated air supplied to the air inlet 26 of the tub 20 may be discharged outside of the tub 20 through the tub exhaust port 220. In order to transfer the humid air discharged from the tub 20 back into the drying device 70, the tub back 200 requires a path connecting to the drying device 70. According to the embodiment, the exhaust path P may be provided to transfer the humid air discharged from the tub 20 back to the drying device 70.

Meanwhile, in order to mount the bearing housing 51 on the tub back 200 and withstand the pressure and load caused by the water stored in the tub 20, the tub back 200 needs to have sufficient rigidity. To this end, the plurality of reinforcing ribs 201 may be formed on the tub back 200. Since the reinforcing ribs 201 protrude rearward from the rear surface of the tub back 200, the thickness of the tub back 200 in the front-back direction becomes thicker by the protruding length of the reinforcing ribs 201. In this structure, mounting a separate duct on the reinforcing ribs 201 of the tub back 200 requires securing a capacity inside the housing 10 to accommodate the size of the duct. In other words, the internal space of the housing 10 needs to also increase in the front-back direction by the thickness of the duct separately mounted on the tub back 200 in the front-back direction.

According to the present disclosure, the reinforcing rib 201 is not formed in a portion of the tub back 200 such that the portion of the tub back 200 may be utilized as a path. When the length from the front surface of the tub back 200 to the rear end of the reinforcing rib 201 is referred to as a thickness of the tub back 200, a portion of the tub back 200 may appear to be recessed. In the present disclosure, the recessed portion 210 formed in the tub back 200 may refer to an area that extends from the tub exhaust port 220 of the tub back 200 toward the upper side of the tub back 200 without having the reinforcing ribs 201 or an area that protrudes less than the reinforcing ribs 201.

The plurality of reinforcing ribs 201 may reinforce the strength of the tub back 200. The plurality of reinforcing ribs 201 may include annular reinforcing ribs 201*b* having the same center as the center of the tub penetration hole 240. The annular reinforcing ribs 201*b* may have different radii. The plurality of reinforcing ribs 201 may include radial reinforcing ribs 201*a* extending radially from the tub penetration hole 240. The radial reinforcing ribs 201*a* may extend by passing through the annular reinforcing ribs 201*b*.

Referring to FIG. 6, the tub back 200 may be formed with the tub exhaust port 220 such that air inside the tub 20 is discharged.

The tub exhaust ports 220 may be formed in plural. The plurality of tub exhaust ports 220 may be positioned spaced apart from each other. The plurality of tub exhaust ports 220 may be arranged at intervals along the recessed portion 210.

The tub exhaust ports 220 may include a first tub exhaust port 221 formed in a lower section of the recessed portion 210, a second tub exhaust port 222 formed in a section above the first tub exhaust port 221, and a third tub exhaust port 223 formed in a section above the second tub exhaust port 222.

The first tub exhaust port 221 may be formed in a lower section of the recessed portion 210. The first tub exhaust port 221 may be arranged downward relative to the center of the tub back 200. The first tub exhaust port 221 may be arranged adjacent to the lower end of the recessed portion 210.

The second tub exhaust port 222 may be formed at a position spaced upwardly from the first tub exhaust port 221. The second tub exhaust port 222 may be arranged above the first tub exhaust port 221. The second tub exhaust port 222 may be arranged downward relative to the center of the tub back 200. Since the second tub exhaust port 222 is arranged with an interval from the first tub exhaust port 221, the decrease in strength of the tub back 200 may be reduced compared to when the second tub exhaust port 222 and the first tub exhaust port 221 are provided as one exhaust port.

The third tub exhaust port 223 may be formed at a position spaced upwardly from the second tub exhaust port 222. The third tub exhaust port 223 may be arranged above the second tub exhaust port 222. At least a portion of the third tub exhaust port 223 may be arranged upward relative to the center of the tub back 200.

The sum of the area of the first tub exhaust port 221 and the area of the second tub exhaust port 222 may be provided to be larger than the area of the third tub exhaust port 223. The area of the tub exhaust port 220 formed in a region below the center of the tub back 200 may be provided to be larger than the area of the tub exhaust port 220 formed in a region above the center of the tub back 200. That is, the tub exhaust port 220 may be formed to have a larger area in a region below the center of the tub back 200.

The reinforcing bracket 100 may include a bracket exhaust port 120 formed in a rigidity reinforcing portion 110.

The bracket exhaust port 120 may correspond to the tub exhaust port 220. Since the bracket exhaust port 120 corresponds to the tub exhaust port 220, air may be discharged to the outside of the tub 20 through the bracket exhaust port 120 and the tub exhaust port 220. When the reinforcing bracket 100 is inserted into the tub back 200, the bracket exhaust port 120 and the tub exhaust port 220 may substantially represent the same hole.

According to an embodiment, the bracket exhaust port 120 may include a first bracket exhaust port 121 having a position and shape corresponding to the first tub exhaust port 221, a second bracket exhaust port 122 having a position and shape corresponding to the second tub exhaust port 222, and a third bracket exhaust port 123 having a position and shape corresponding to the third tub exhaust port 223.

The first bracket exhaust port 121 may be arranged adjacent to the lower end of the rigidity reinforcing portion 110. The first bracket exhaust port 121 may be positioned in a region below the center of the reinforcing bracket 100.

The second bracket exhaust port 122 may be arranged above the first bracket exhaust port 121. The second bracket exhaust port 122 may be positioned downward relative to the center of the reinforcing bracket 100.

The third bracket exhaust port 123 may be arranged above the second bracket exhaust port 122. The third bracket exhaust port 123 may be positioned upward relative to the center of the reinforcing bracket 100.

Similar to the first tub exhaust port 221, the second tub exhaust port 222, and the third tub exhaust port 223, the sum of the area of the first bracket exhaust port 121 and the area of the second bracket exhaust port 122 may be provided to be larger than the area of the third bracket exhaust port 123.

In addition, the distances between the first bracket exhaust port 121, the second bracket exhaust port 122, and the third bracket exhaust port 123 may be set such that the second bracket exhaust port 122 and the third bracket exhaust port 123 are positioned as close as possible to the first bracket exhaust port 121 while maintaining the structural rigidity of the tub 20 and the tub back 200. In addition, the distances may be set to a theoretical calculation value or an experimental value obtained through repeated experiments.

The bracket exhaust port 120 is not limited to the above. The tub exhaust ports may be provided as one hole. In response to the tub exhaust ports being formed as one hole, the bracket exhaust port 120 may also form one hole extending in the lengthwise direction of the flow path. In this case, a larger hole is formed, leading to increased air volume and improved drying efficiency.

As described above, in order that the heated air introduced into the tub 20 through the air inlet 26 effectively contacts the laundry inside the drum 30, it is appropriate to maximally space the tub exhaust port 220 apart from the air inlet 26 in the front/back direction, upper/lower direction, and left/right direction. Therefore, forming the penetration area of the tub exhaust port 220 to be larger in the lower section than in the upper section of the recessed portion 210 is beneficial in drying efficiency. Conversely, when the penetration area of the tub exhaust port 220 is formed larger in the upper section than in the lower section of the recessed portion 210, the air circulating through the drying device 70 may be concentrated only in the upper section in the drum 30, which may reduce the drying efficiency of the laundry accommodated inside the drum 30.

However, in order to secure sufficient flow rate, the tub exhaust port 220 may include an area formed upward relative to the center of the tub back 200. For example, the tub exhaust port 220 may include the third tub exhaust port 223 formed upward relative to the center of the tub back 200.

In addition, the distances between the first tub exhaust port 221, the second tub exhaust port 222, and the third tub exhaust port 223 may be set such that the second tub exhaust port 222 and the third tub exhaust port 223 are positioned as close as possible to the first tub exhaust port 221 while maintaining the structural rigidity of the tub 20 and the tub back 200. In addition, the distances may be set to a theoretical calculation value or an experimental value obtained through repeated experiments.

In this drawing, the tub exhaust ports 220 are illustrated as including three tub exhaust ports, but the disclosure is not limited thereto. The shape, number, and arrangement of the tub exhaust ports 220 may be provided in various forms. For example, the tub exhaust port 220 may be provided in the form of a dense array of small holes, or in the form of a mesh or grille. Alternatively, the tub exhaust port 220 may form a single exhaust port extending along the length direction of the exhaust path.

The first tub exhaust port 221 may further include a tub drainage groove 221*a*. The tub drainage groove 221*a* may allow water to be drained into the tub 20 without remaining between the lower portion of the recessed portion 210 and the lower portion of the partition rib 230. The tub drainage groove 221*a* may be formed by at least a portion of the first tub exhaust port 221 being extended to the lower end of the partition rib 230. The tub drainage groove 221*a* may be formed to be inclined downward toward the inside of the tub 20 to facilitate drainage.

The tub 20 may be formed using a plastic material with relatively low strength. In order to reinforce the strength of the tub 20, the plurality of reinforcing ribs 201 may be provided on the tub back 200. In addition, in order to further reinforce the strength of the tub back 200, the reinforcing bracket 100 may be inserted into the tub back 200. That is, during injection-molding of the tub 20, the tub 20 may be injection-molded with the reinforcing bracket 100 inserted thereto.

The reinforcing bracket 100 may include a material having a higher strength than the material forming the tub 20. The reinforcing bracket 100 may be formed through aluminum die casting (ALDC) or of stainless steel. Since the reinforcing bracket 100 includes a material having a higher strength than the material forming the tub 20, the inserting of the reinforcing bracket 100 into the tub back 200 may reinforce the strength of the tub back 200.

The tub back 200 may be formed with the tub penetration hole 240 that allows the rotating shaft 41 of the drive motor 42 to pass therethrough. A bearing is inserted into the tub penetration hole 240, and the bearing may rotatably support the rotating shaft 41.

The load due to the water and laundry contained inside the drum 30 is transferred through the rotating shaft 41 and the bearing to the tub back 200 in which the tub penetration hole 240 is formed. Since the tub back 200 is weak in strength to support the load, a bearing housing 51 may be provided on the inner side of the tub back 200.

The second region R2 of the tub back 200 may be weaker in strength than the first region R1. Since the second region R2 is formed with the recessed portion 210 and the tub exhaust port 220, the second region R2 may be weaker in strength than the first region R1 in which the reinforcing ribs 201 are provided.

The clothing treating apparatus 1 according to an embodiment may include the reinforcing bracket 100 provided to reinforce the rigidity of the second region R2 of the tub back 200.

The reinforcing bracket 100 may include a rigidity reinforcing portion 110 provided to reinforce the strength of the recessed portion 210. The rigidity reinforcing portion 110 may be provided to be coupled to the recessed portion 210. The reinforcing bracket 100 according to the embodiment of the present disclosure may be coupled to the tub back 200 in a way to be inserted into the tub back 200. The rigidity reinforcing portion 110 may have a bracket exhaust port 120 corresponding to the tub exhaust port 220.

When the reinforcing bracket 100 is inserted into the tub back 200, the tub exhaust port 220 and the bracket exhaust port 120 may be positioned to correspond to each other. That is, the tub exhaust port 220 and the bracket exhaust port 120 may form one hole. The air discharged from inside the tub 20 may be discharged through the hole formed by the tub exhaust port 220 and the bracket exhaust port 120.

The reinforcing bracket 100 may be positioned at an outside of the bearing housing 51 along the radial direction of the bearing housing 51. The outside of the bearing housing 51 may refer to a location farther away from the center of a bearing penetration hole 510, which is the center of the bearing housing 51, than a leg portion 511 that extends radially from the center of the bearing penetration hole 510. In other words, the reinforcing bracket 100 may be positioned farther away from the bearing penetration hole 510 in the extension direction of the leg portion 511 than the end of the leg portion 511.

The reinforcing bracket 100 may include a bracket extension portion 160 extending along the circumferential direction of the bearing housing 51. The bracket extension portion 160 may be arranged on the outside along the radial direction of the tub back 200. The bracket extension portion 160 may form a circle together with the rigidity reinforcing portion 110. That is, the bracket extension portion 160 and the rigidity reinforcing portion 110 may each have an arc shape with a different length. The bracket extension portion 160 and the rigidity reinforcing portion 110 may be parts of a circle having the same center.

The bracket extension portion 160 may include a plurality of bracket ribs 150. The plurality of bracket ribs 150 may be formed to correspond to the plurality of reinforcing ribs 201 formed on the tub back 200.

The plurality of bracket ribs 150 may include annular bracket ribs 151 that are provided to correspond to the annular reinforcing ribs 201*b* that constitute the plurality of reinforcing ribs 201. The annular bracket ribs 151 may form parts of concentric circles based on the center of the reinforcing bracket 100. That is, the annular bracket ribs 151 may share the center of the reinforcing bracket 100 but may have different radii.

The plurality of bracket ribs 150 may include radial bracket ribs 152 that are provided to correspond to the radial reinforcing ribs 201*a* that constitute the plurality of reinforcing ribs 201. The radial bracket ribs 152 may extend radially from the center of the reinforcing bracket 100 on the bracket extension portion 160.

The bearing housing 51 may be inserted into the tub penetration hole 240 that is the center of the tub back 200. Accordingly, the reinforcing bracket 100 may be arranged outside of a portion of the tub back 200 in which the tub penetration hole 240 is formed. The reinforcing bracket 100 may be inserted into a region outside of the tub penetration hole 240 along the radial direction of the tub back 200.

The reinforcing bracket 100 may further include a bracket drainage groove 121*a*.

The bracket drainage groove 121*a* may be formed in the first bracket exhaust port 121 to correspond to the tub drainage groove 221*a* formed in the first tub exhaust port 221. The bracket drainage groove 121*a* may be formed by at least a portion of the first bracket exhaust port 121 being extended to the lower end of the rib reinforcing portion 130. The bracket drainage groove 121*a* may be formed to be inclined toward the inside of the tub 20, similar to the tub drainage groove 221*a*.

The tub back 200 may include a stepped portion 211 to expand the cross-sectional area of the exhaust passage P. The exhaust passage P may be formed such that the width of a portion formed by the duct connection portion 270 is larger than the width of a portion formed in the recessed portion 210 by the stepped portion 211. The stepped portion 211 may be formed by a part of the recessed portion 210 being stepped forward more than the remaining part of the recessed portion 210.

The recessed portion 210 and the front end of the duct connection portion 270 may be formed to be spaced apart in the front-back direction. In other words, the front end of the duct connection portion 270 that forms a part of the exhaust path P may be located in front of the recessed portion 210. The stepped portion 211 may extend obliquely from the recessed portion 210 toward the duct connection portion 270 to connect the recessed portion 210 and the front end of the duct connection portion 270. The stepped portion 211 may be formed to facilitate the flow of air on the downstream side of the exhaust path P connected to the inlet path 76.

The reinforcing bracket 100 may include an avoidance portion 111 corresponding to the stepped portion 211. The avoidance portion 111 may be formed to avoid insertion of the reinforcing bracket 100 into a region that is more recessed than the recessed portion 210 because it is difficult to insert the reinforcing bracket 100 into the region. The avoidance portion 111 may be formed in a region of the rigidity reinforcing portion 110 corresponding to the stepped portion 211. The avoidance portion 111 may refer to a groove or hole having a shape corresponding to the stepped portion 211. Since the avoidance portion 111 is a groove or hole having a shape corresponding to the stepped portion 211, the reinforcing bracket 100 may not be inserted into the interior of the stepped portion 211. In other words, the bearing housing may not be formed in a region corresponding to the stepped portion 211 of the tub back 200.

The tub back 200 may include a partition rib 230 protruding from the edge of the recessed portion 210 toward the rear of the tub back 200 to divide a part of the tub back 200 in which the recessed portion 210 is formed from the remaining part of the tub back 200.

The partition rib 230 may divide the first region R1 from the second region R2. The partition rib 230 may be formed to surround the recessed portion 210. The partition rib 230 may protrude from the tub back 200 while extending along the periphery of the recessed portion 210.

The height of the partition rib 230 may be provided higher than the height of the plurality of reinforcing ribs 201. The fact that the height of the partition rib 230 is provided higher than the height of the plurality of reinforcing ribs 201 may indicate that the partition rib 230 protrudes further toward the rear of the tub back 200 than the plurality of reinforcing ribs 201 protrude toward the rear of the tub back 200. In other words, the partition rib 230 may protrude further toward the rear of the tub back 200 than the plurality of reinforcing ribs 201.

The partition rib 230 may include an outer partition rib 231, an inner partition rib 232, and a connecting partition rib 233.

The outer partition rib 231 may be arranged at one side of the tub exhaust port 220 in the radial direction of the tub back 200. The inner partition rib 232 may be arranged at another side of the tub exhaust port 220 in the radial direction of the tub back 200. The connecting partition rib 233 may be provided to connect the outer partition rib 231 and the inner partition rib 232. The outer partition rib 231 may be positioned farther away from the tub penetration hole 240 in the radial direction of the tub back 200 than the inner partition rib 232. Therefore, the one side of the tub exhaust port 220 may be referred to as an outer side of the tub exhaust port 220, and the other side of the tub exhaust port 220 may be referred to as an inner side of the tub exhaust port 220.

The inner partition rib 232 may be extended from the annular reinforcing rib 201*b* to form a circular rib together with the annular reinforcing rib 201*b*. The outer partition rib 231 may be formed along the edge of the tub back 200 having a disc shape. The outer partition rib 231 may be formed to protrude rearward from the rear edge of the tub back 200. As described above, the inner partition rib 232 may protrude further rearward of the tub back 200 than the annular reinforcing rib 201*b* that forms the circular rib together with the inner partition rib 232. The outer partition rib 231 may protrude rearward of the tub back 200 such that the rear end of the outer partition rib 231 is positioned on the same plane as the rear end of the inner partition rib 232.

The tub back 200 may include a plurality of tab holes 212*a* spaced apart along the partition rib 230. The plurality of tab holes 212*a* may be formed on the outer side of the recessed portion 210. The plurality of tab holes 212*a* may be formed adjacent to each of the outer partition rib 231, the inner partition rib 232, and the connecting partition rib 233.

The plurality of tap holes 212*a* may be coupled with the duct cover 300. The plurality of tap holes 212*a* may be arranged at a predetermined interval from each other. The plurality of tap holes 212*a* may be formed through tapping for fastening with screws. However, the present disclosure is not limited thereto, and holes for fastening with rivets, etc. may be formed.

The reinforcing bracket 100 may include a rib reinforcing portion 130 provided to be inserted into the partition rib 230.

The rib reinforcing portion 130 may include an outer rib reinforcing portion 131 provided to correspond to the outer partition rib 231 to reinforce the strength of the outer partition rib 231, an inner rib reinforcing portion 132 provided to correspond to the inner partition rib 232 to reinforce the strength of the inner partition rib 232, and a connecting rib reinforcing portion 133 provided to correspond to the connecting partition rib 233 to reinforce the strength of the connecting partition rib 233.

The inner rib reinforcing portion 132 may form one circle together with one of the annular bracket ribs 151. Specifically, the inner rib reinforcing portion 132 may form a circle together with the bracket rib 151 located innermost among the annular bracket ribs 151. That is, a part of the innermost concentric circle among parts of the concentric circles formed by the annular bracket ribs 151 may be connected to the inner rib reinforcing portion 132.

The radius of the circle formed by the inner rib reinforcing portion 132 and the innermost bracket rib 151 among the annular bracket ribs 151 may correspond to the radius of the bearing housing 51. However, the fact that the radii corresponding to each other may not mean that the radii are completely the same. In the present disclosure, the bearing housing 51 may have a smaller radius than the circle formed by the inner rib reinforcing portion 132 and the annular bracket rib 151.

The rib reinforcing portion 130 may be inserted into a position corresponding to the partition rib 230 to reinforce the rigidity of the partition rib 230.

The bearing housing 51 and the reinforcing bracket 100 may be provided to be coupled to each other. The bearing housing 51 may include a housing coupling portion 5111 provided at an end portion of the leg portion 511. Correspondingly, the reinforcing bracket 100 may include a bracket coupling portion 140.

The housing coupling portion 5111 may be formed only on some of the plurality of leg portions 511. In the present disclosure, the housing coupling portion 5111 is illustrated as being formed only on the leg portion 511 positioned adjacent to the rigidity reinforcing portion 110 among the plurality of leg portions 511, but it is not limited thereto.

When the tub back 200 is injection-molded, the bearing housing 51 and the reinforcing bracket 100 may be inserted while being coupled to each other. That is, the bearing housing 51 and the reinforcing bracket 100 may be coupled in advance before the tub back 200 is injected-molded. The housing coupling portion 5111 and the bracket coupling portion 140 may be coupled through a fastening member (not shown). The fastening member (not shown) may be a bolt, a rivet, etc. However, the bearing housing 51 and the reinforcing bracket 100 may be inserted without being coupled to each other in advance.

Referring to FIGS. 8 and 9, a reinforcing bracket 100A according to an embodiment of the present disclosure will be described.

The reinforcing bracket 100A may be formed to correspond to the tub duct 213 of the tub back 200. The tub duct 213 may have weaker rigidity than the first region R1 in which the reinforcing ribs 201 are formed. Therefore, the reinforcing bracket 100A may be provided in a shape corresponding to the tub duct 213.

Since the reinforcing bracket 100A has a shape corresponding only to the tub duct 213, the structure may be simplified. In addition, since the reinforcing bracket 100A is disposed only on the tub duct 213 that requires reinforced rigidity, the weight of the tub 20, etc. may be reduced.

The reinforcing bracket 100A may be formed to correspond to the recessed portion 210, the tub exhaust port 220, and the partition rib 230 of the tub duct 213.

Specifically, the reinforcing bracket 100A may include a rigidity reinforcing portion 110 corresponding to the recessed portion 210, a bracket exhaust port 120 corresponding to the tub exhaust port 220, and a rib reinforcing portion 130 corresponding to the partition rib 230. In addition, the reinforcing bracket 100A may include an avoidance portion 111 formed to correspond to the stepped portion 211.

The reinforcing bracket 100A may be inserted into the tub back 200. In this case, the reinforcing bracket 100A may be coupled to the bearing housing 51.

When the tub back 200 is injection-molded, the bearing housing 51 and the reinforcing bracket 100A may be inserted while being coupled to each other. A housing coupling portion 5111 and a bracket coupling portion 140 may be coupled to each other through a fastening member (not shown). The fastening member (not shown) may be a bolt, a rivet, etc. However, the bearing housing 51 and the reinforcing bracket 100 may be inserted without being coupled in advance.

Hereinafter, a clothing treating apparatus in which a reinforcing bracket is coupled to the outside of a tub back is described. The same reference numerals are assigned to the same configurations as those in the above-described embodiment, and detailed description thereof may be omitted; only the different configurations may be described in detail.

Figure 10:
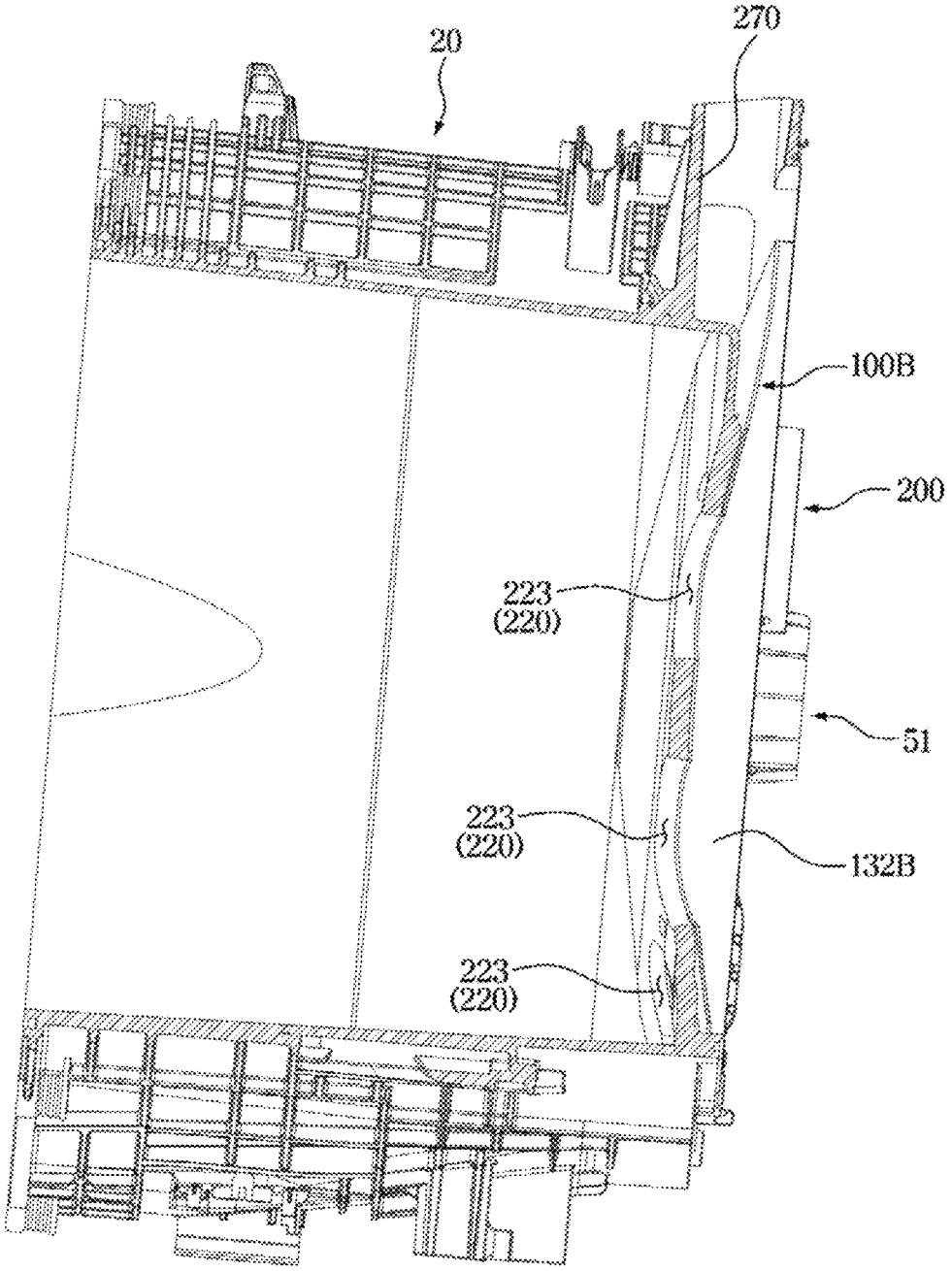
FIG. 10 is a cross-sectional view illustrating a state in which the reinforcing bracket is coupled to the outer side of the tub according to an embodiment.
Figure 11:
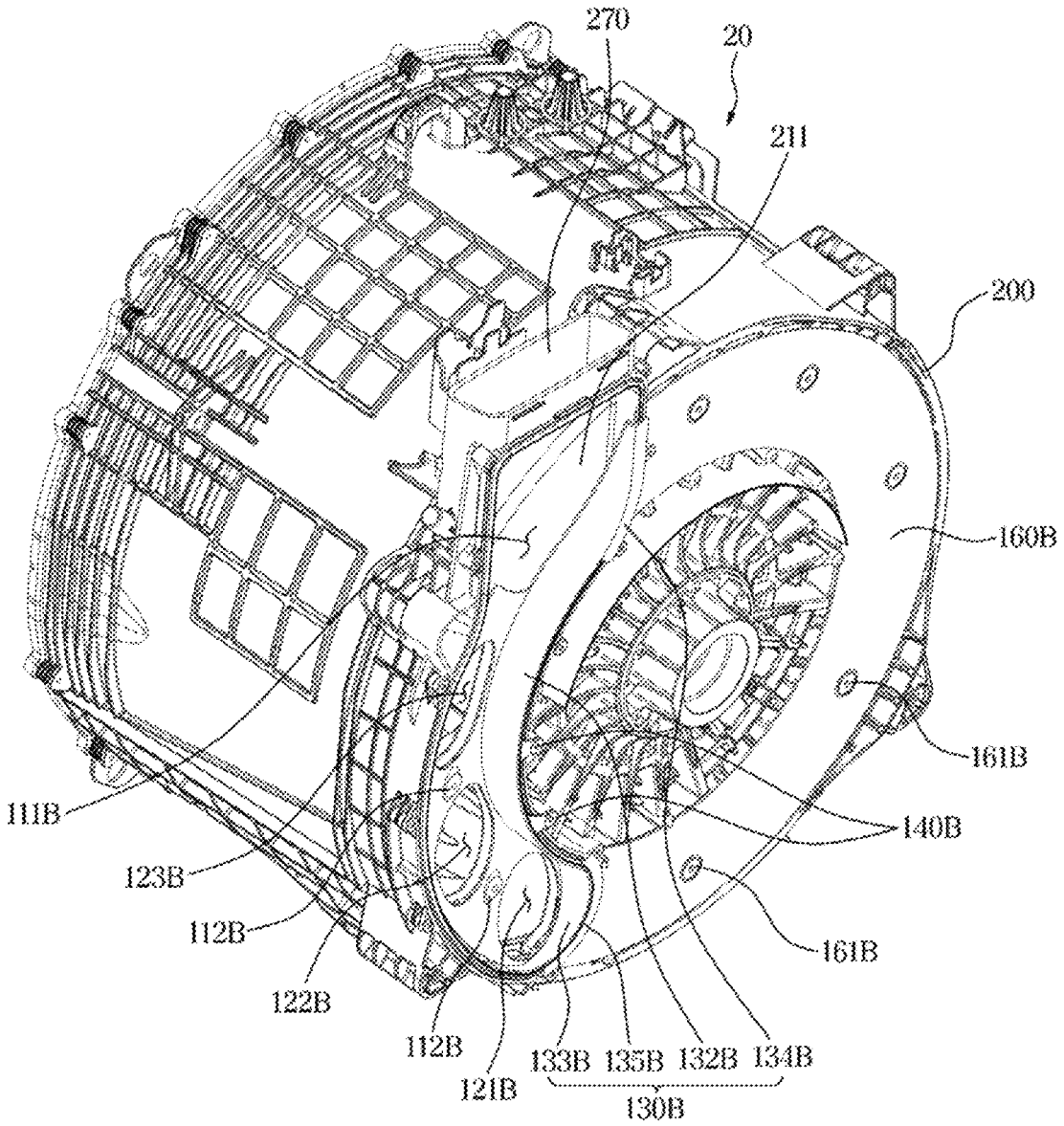
FIG. 11 is a perspective view illustrating the tub and the reinforcing bracket coupled to the tub as shown in FIG. 10.
Figure 12:
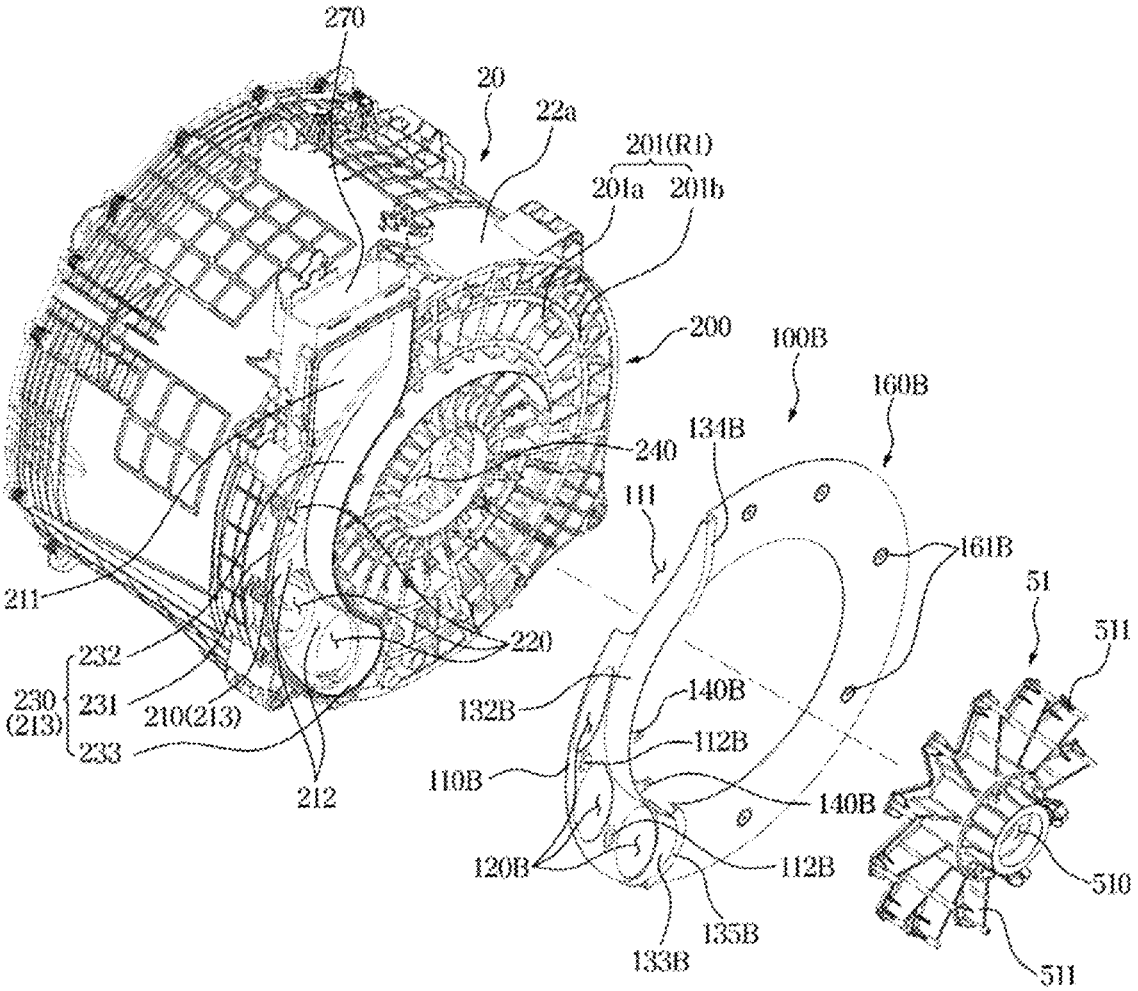
FIG. 12 is a view illustrating a state in which the reinforcing bracket and the tub shown in FIG. 11 are disassembled.
Figure 13:
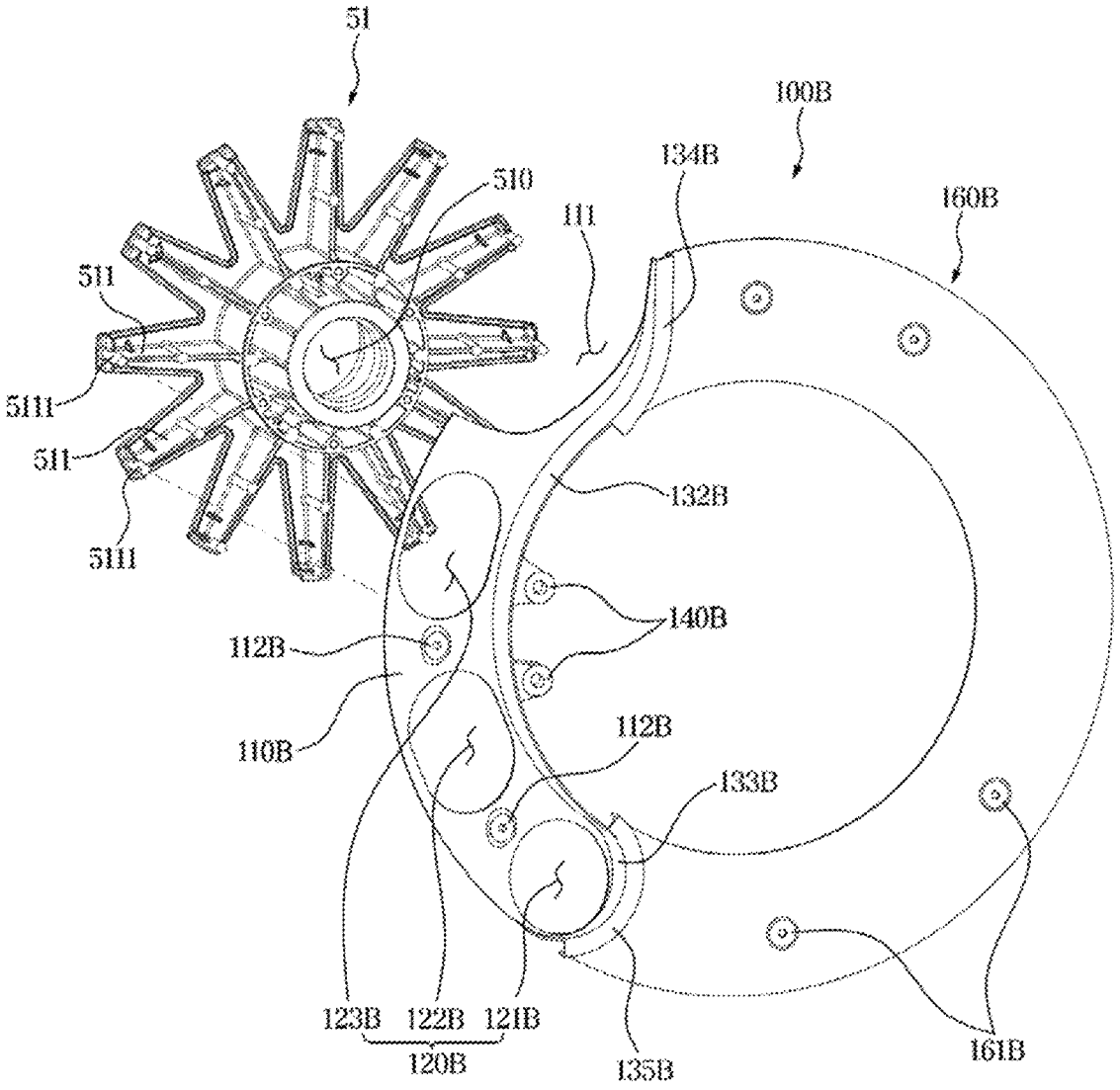
FIG. 13 is a view illustrating the structure of the reinforcing bracket and the bearing housing of FIG. 12.

FIG. 10 is a cross-sectional view illustrating a state in which the reinforcing bracket is coupled to the outer side of the tub according to an embodiment. FIG. 11 is a perspective view illustrating the tub and the reinforcing bracket coupled to the tub as shown in FIG. 10. FIG. 12 is a view illustrating a state in which the reinforcing bracket and the tub of FIG. 11 are disassembled. FIG. 13 is a view illustrating the structure of the reinforcing bracket and the bearing housing of FIG. 12.

Referring to FIGS. 10 to 13, a clothing treating apparatus 1 according to an embodiment of the present disclosure may include a reinforcing bracket 100B provided to be coupled to the outside of a tub 20.

The reinforcing bracket 100B may be coupled to the rear of a tub back 200. That is, the reinforcing bracket 100B may be coupled on a tub duct 213.

The reinforcing bracket 100B may include a first bracket exhaust port 121B having a position and shape corresponding to a first tub exhaust port 221, a second bracket exhaust port 122*b* having a position and shape corresponding to a second tub exhaust port 222, and a third bracket exhaust port 123B) having a position and shape corresponding to a third tub exhaust port 223.

The reinforcing bracket 100B may include a rigidity reinforcing portion 110*b* provided to be coupled to the recessed portion 210. The rigidity reinforcing portion 110*b* may include a duct coupling portion 112 that allows the rigidity reinforcing portion 110*b* to be coupled to the recessed portion 210. The duct coupling portion 112B may be coupled to a recess coupling portion 212 provided on the recessed portion 210. The duct coupling portion 112B and the recess coupling portion 212 may be coupled to each other through a fastening member. The fastening member may be a bolt, a rivet, or the like.

The reinforcing bracket 100B may include a rib reinforcing portion 130B extending along the inner side of the partition rib 230.

The rib reinforcing portion 130B may include an inner rib reinforcing portion 132B provided to reinforce the rigidity of the inner partition rib 232. The inner rib reinforcing portion 132B may be arranged on the inner side of the inner partition rib 232, that is, in the recessed portion 210. In other words, the inner rib reinforcing portion 132B may be formed by being bent from the rigidity reinforcing portion 110*b*.

The rib reinforcing portion 130B may include a connecting rib reinforcing portion 133B that extends along the inner side of the connecting partition rib 233. The connecting rib reinforcing portion 133B may also be arranged on the inner side of the connecting partition rib 232, that is, in the recessed portion 210. Similarly, the connecting rib reinforcing portion 133B may be formed by being bent from the rigidity reinforcing portion 110*b*.

The rib reinforcing portion 130B may include an inner bent portion 134B that is provided to surround at least a portion of the inner partition rib 232. The inner bent portion 134B may be formed by being bent from the inner rib reinforcing portion 132B to surround the inner partition rib 232. That is, the inner partition rib 232 may be inserted into a gap formed by a bent of the inner bent portion 134B.

Similarly, the rib reinforcing portion 130B may include a connecting bent portion 135B provided to surround at least a portion of the connecting partition rib 233. The connecting bent portion 135B may be formed by being folded from the connecting rib reinforcing portion 133B to surround the connecting partition rib 233. The connecting partition rib 233 may be inserted into a gap formed by a bent of the connecting bent portion 135B.

In the disclosure, the inner bent portion 134B and the connecting bent portion 135B are illustrated as separate components, but they may be formed as one part by extending along the inner rib reinforcing portion 132B. In addition, the rib reinforcing portion 130B may include an outer rib reinforcing portion that extends along the outer partition rib.

The reinforcing bracket 100B may include a bracket extension portion 160B that extends along the circumferential direction. The bracket extension portion 160B may be coupled to the rear of the tub back 200. The bracket extension portion 160B may form a circle together with the rigidity reinforcing portion 110*b*.

The bracket extension portion 160B may include a tub coupling portion 161B that is provided to be coupled to the tub back 200. The tub coupling portion 161B may be arranged spaced apart from each other along the extension direction of the bracket extension portion 160B. The number and location of the tub coupling portions 161B may be provided in various ways.

The reinforcing bracket 100B may include a bracket coupling portion 140B provided to be coupled with the bearing housing 51.

The housing coupling portion 5111 of the bearing housing 51 may penetrate a part of the tub back 200 and be exposed to the rear side. The housing coupling portion 5111 may be directly coupled to the bracket coupling portion 140B. However, the present disclosure is not limited thereto, and the housing coupling portion 5111 may be coupled to the bracket coupling portion 140B with a part of the tub back 200 interposed therebetween.

The tub coupling portion 161B may also be coupled to the housing coupling portion 5111 of the bearing housing 51 inserted into the tub back 200. The tub coupling portion 161B and the housing coupling portion 5111 may be coupled through a fastening member penetrating through the tub coupling portion 161B and the housing coupling portion 5111.

As described above, the rigidity of the tub back 200 may be reinforced through the reinforcing bracket 100B coupled to the rear of the tub back 200. In particular, the rigidity of the tub duct 213 having weaker rigidity may be reinforced.

Figure 14:
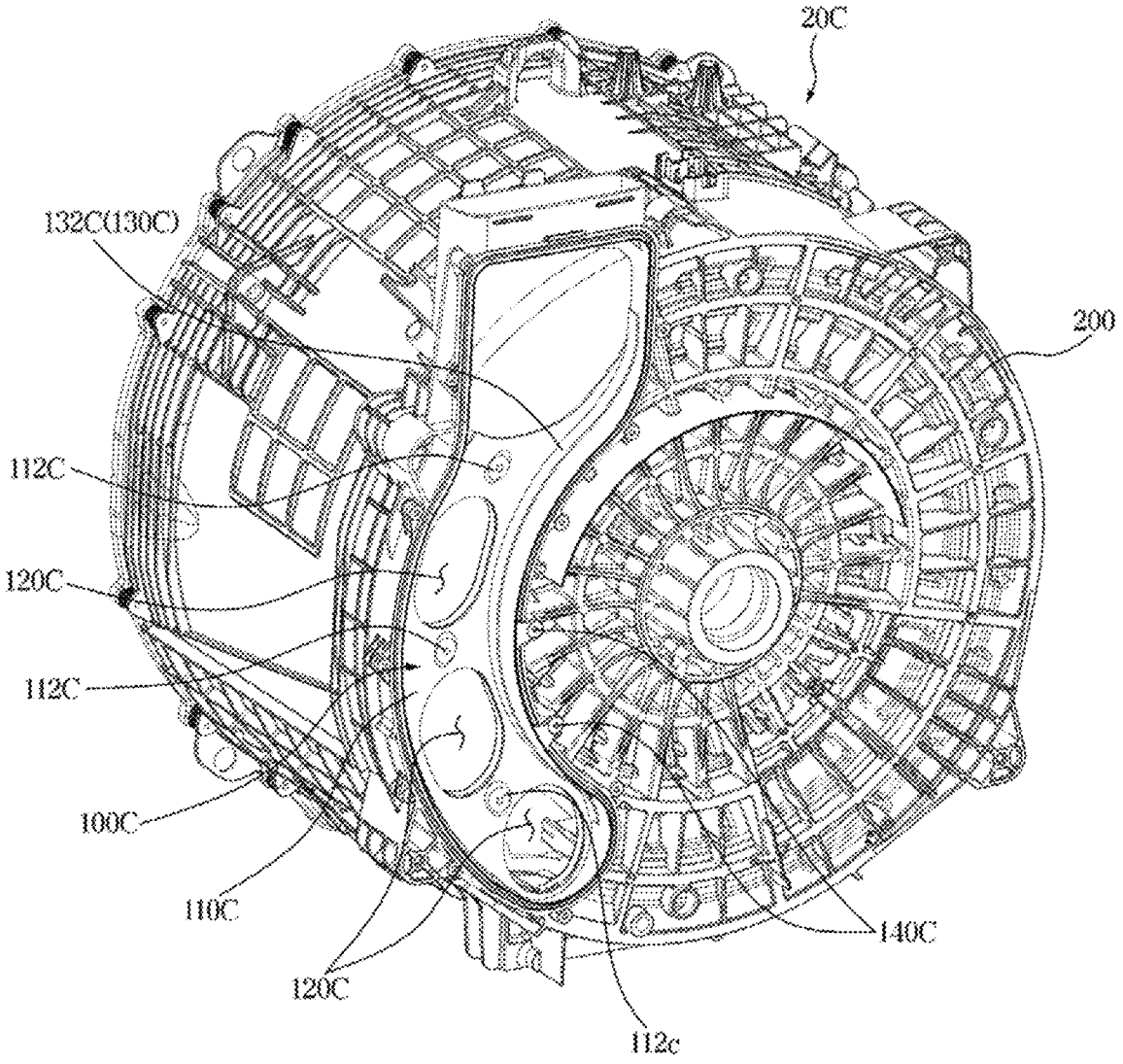
FIG. 14 is a perspective view illustrating a tub to which a reinforcing bracket is coupled according to an embodiment.
Figure 15:
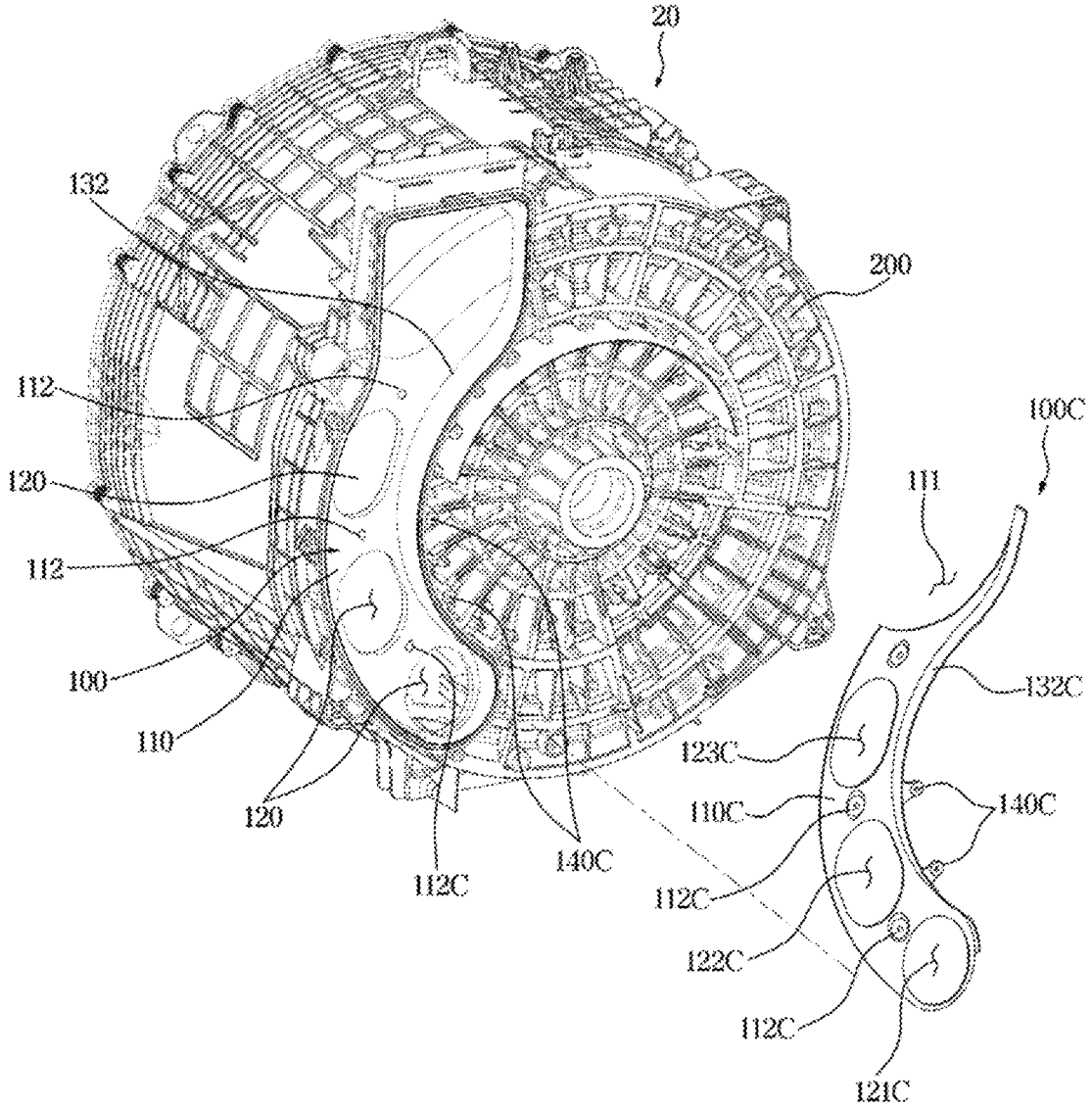
FIG. 15 is a view illustrating a state in which the reinforcing bracket and the tub shown in FIG. 14 are disassembled.

FIG. 14 is a perspective view illustrating a tub to which a reinforcing bracket is coupled according to an embodiment. FIG. 15 is a view illustrating a state in which the reinforcing bracket and the tub shown in FIG. 14 are disassembled.

Referring to FIGS. 14 and 15, a reinforcing bracket 100C according to an embodiment of the present disclosure may be formed to correspond to a tub duct 213.

The reinforcing bracket 100C may be formed to correspond to the tub duct 213 of the tub back 200. The reinforcing bracket 100C may be in a second region R2. The tub duct 213 may have weaker rigidity than the first region R1 in which the reinforcing ribs 201 are formed. Therefore, the reinforcing bracket 100C may be provided in a shape corresponding to the tub duct 213.

Since the reinforcing bracket 100C has a shape corresponding only to the tub duct 213, the structure may be simplified. In addition, since the reinforcing bracket 100C is disposed only on the tub duct 213 that requires rigidity reinforcement, the weight of the tub 20, etc., may be reduced.

The reinforcing bracket 100C may be coupled to the recessed portion 210. The reinforcing bracket 100C may include a duct coupling portion 112C that is provided to be coupled to the recessed portion 210. The duct coupling portion 112C may be arranged between bracket exhaust ports 120C.

The reinforcing bracket 100C may include a rib reinforcing portion 130C that extends along the inner side of the partition rib 230. In the disclosure, only an inner rib reinforcing portion 132C that extends along an inner partition rib 232 is illustrated, but the disclosure is not limited thereto. For example, the rib reinforcing portion 130C may extend along an outer partition rib and a connecting partition rib. That is, the rib reinforcing portion 130C may extend along the circumference of the recessed portion 210 and may reinforce the rigidity of the partition rib 230.

The inner rib reinforcing portion 132C may be formed by being bent from the rigidity reinforcing portion 110*c*. The inner rib reinforcing portion 132C may be formed approximately perpendicular to the rigidity reinforcing portion 110*c*.

The reinforcing bracket 100C may include a bracket coupling portion 140C that is provided to be coupled to a bearing housing 51.

A housing coupling portion 5111 of the bearing housing 51 may penetrate a part of the tub back 200 and be exposed to the rear side. The housing coupling portion 5111 may be directly coupled to the bracket coupling portion 140C. However, the disclosure is not limited thereto, and the housing coupling portion 5111 may be coupled to the bracket coupling portion 140C with a part of the tub back 200 interposed therebetween.

Hereinafter, a clothing treating apparatus in which a reinforcing bracket is coupled to a front side of a tub back is described. The same reference numerals are assigned to the same configurations as those in the above-described embodiment, and detailed description thereof may be omitted; only the different configurations may be described in detail.

Figure 16:
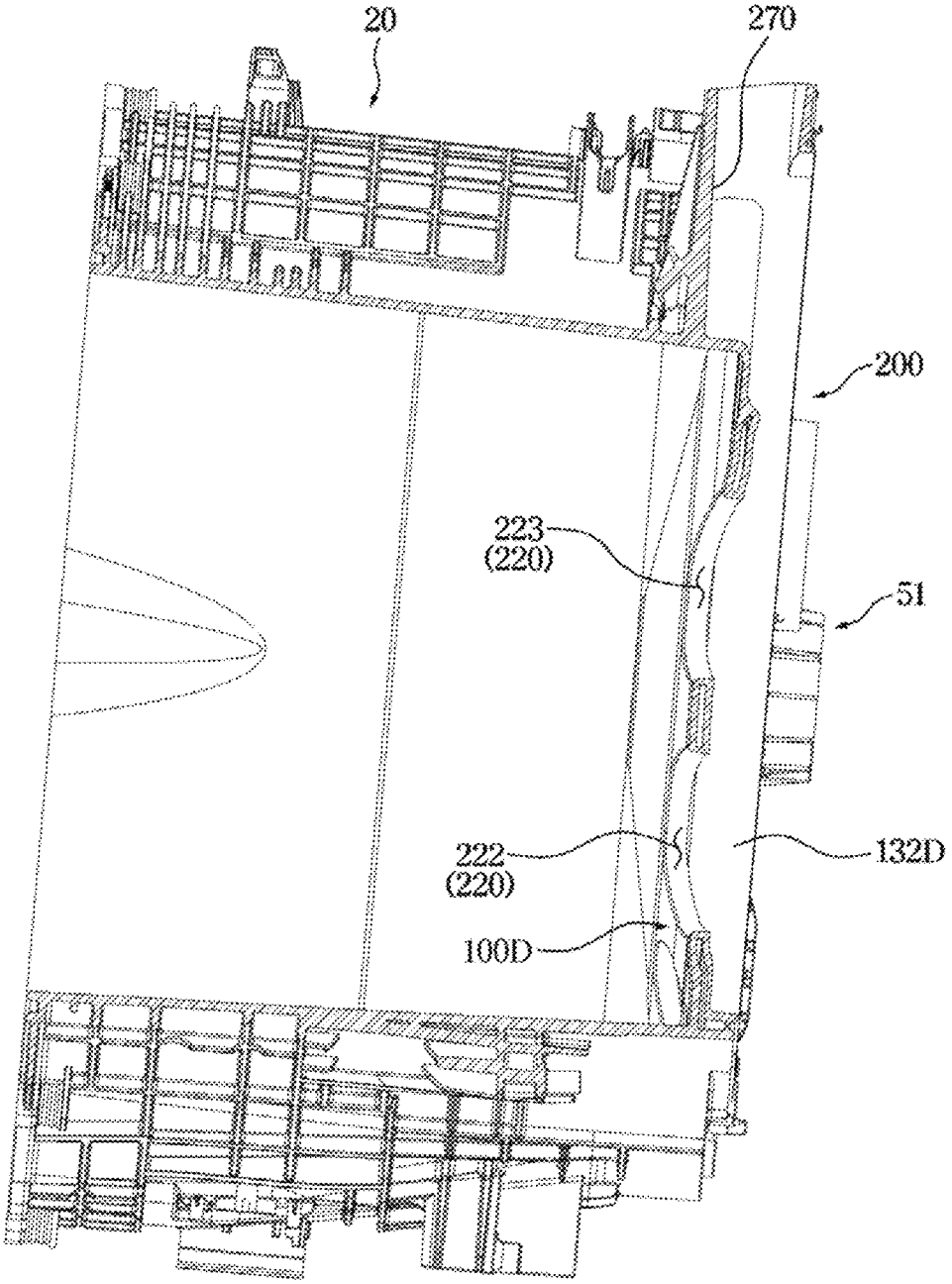
FIG. 16 is a cross-sectional view illustrating a state in which a reinforcing bracket is coupled to the inner side of a tub according to an embodiment.
Figure 17:
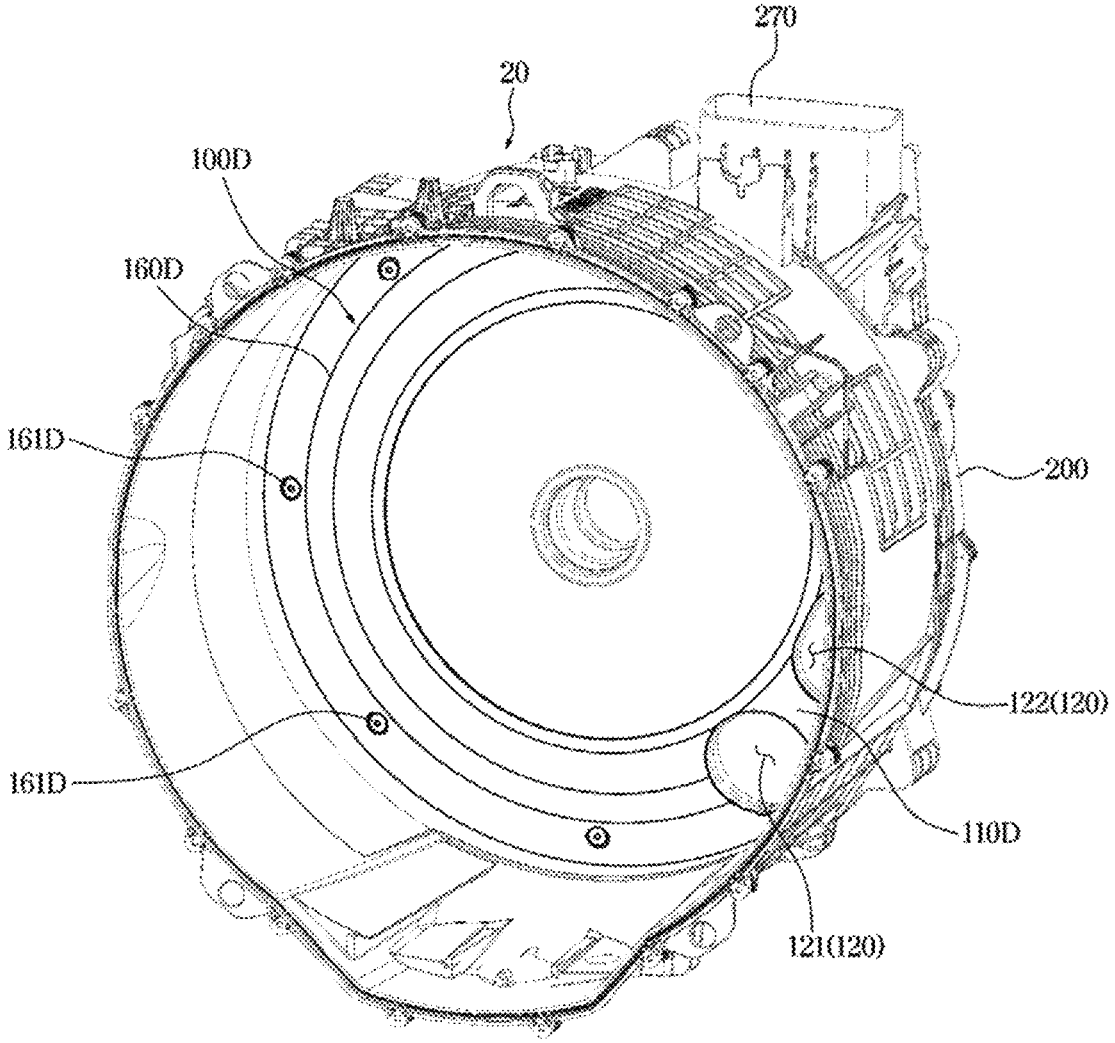
FIG. 17 is a front view of the tub to which the reinforcing bracket is coupled as shown in FIG. 16.
Figure 18:
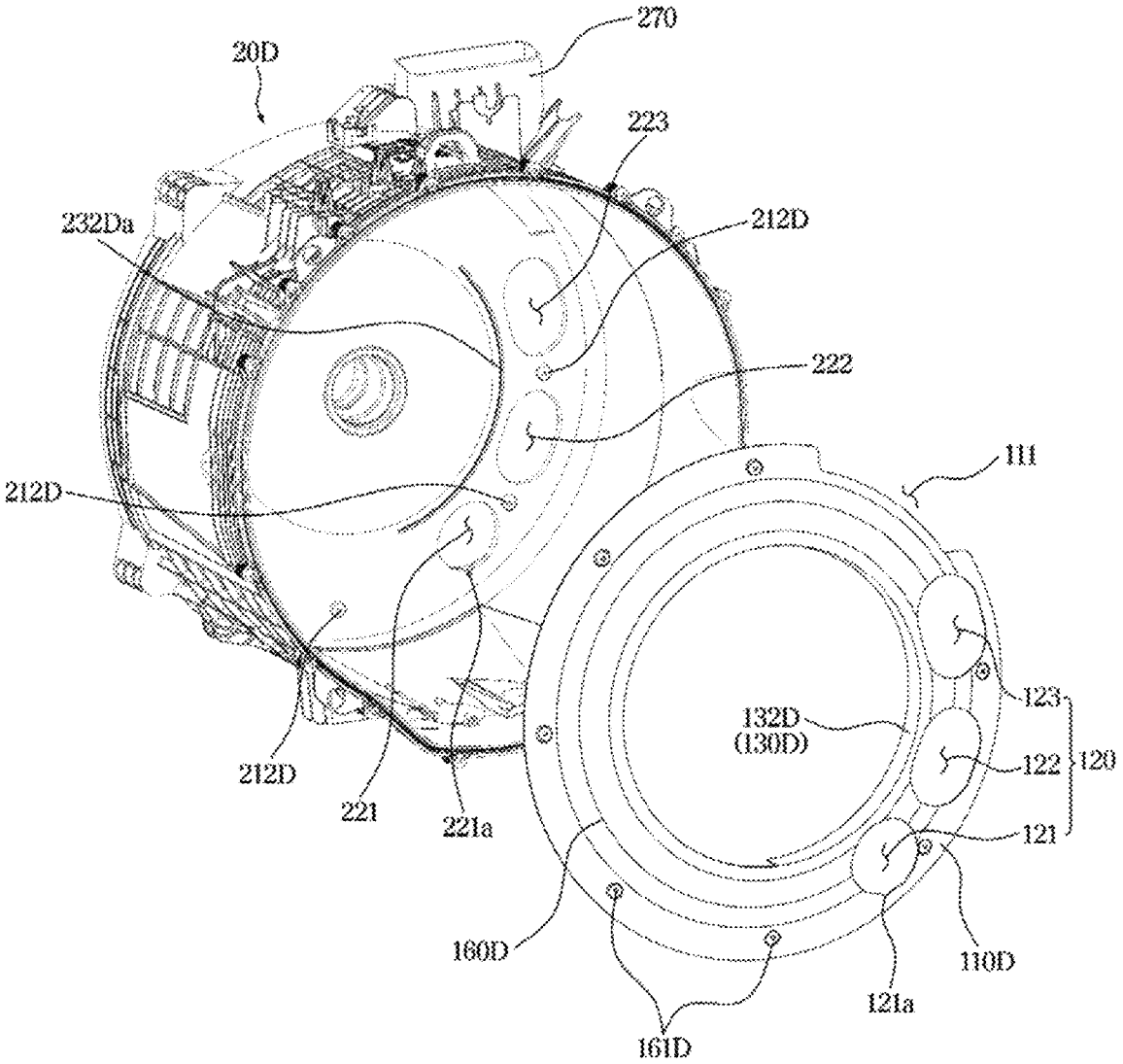
FIG. 18 is a view illustrating a state in which the reinforcing bracket and the tub shown in FIG. 17 are disassembled.

FIG. 16 is a cross-sectional view illustrating a state in which a reinforcing bracket is coupled to the inner side of a tub according to an embodiment. FIG. 17 is a front view of the tub to which the reinforcing bracket is coupled as shown in FIG. 16. FIG. 18 is a view illustrating a state in which the reinforcing bracket and the tub shown in FIG. 17 are disassembled.

Referring to FIGS. 16 to 18, a reinforcing bracket 100D according to an embodiment of the present disclosure may be coupled to the inside of the tub 20. The reinforcing bracket 100D may be coupled to the front side of the tub back 200.

The reinforcing bracket 100D may be coupled along the periphery of the tub back 200. The reinforcing bracket 100D may include a rigidity reinforcing portion 110*d* provided to reinforce the rigidity of the recessed portion 210. The rigidity reinforcing portion 110*d* may be formed with a bracket exhaust port 120 formed to correspond to the tub exhaust port 220.

The reinforcing bracket 100D may include a bracket extension portion 160D extending along the circumferential direction from the rigidity reinforcing portion 100D. The bracket extension portion 160D may include a tub coupling portion 161D for coupling to the front of the tub back 200. The tub coupling portion 161D may be arranged spaced apart from each other along the extension direction of the bracket extension portion 160D.

The tub coupling portion 161D may also be coupled to a housing coupling portion 5111 of a bearing housing 51 inserted into the tub back 200. The tub coupling portion 161D and the housing coupling portion 5111 may be coupled to each other through a fastening member penetrating through the tub coupling portion 161D and the housing coupling portion 5111.

The tub back 200 may include a recess coupling portion 212D that allows the reinforcing bracket 100D to be coupled to the front of the tub back 200. The recess coupling portion 212D may be formed in the recessed portion 210. The recess coupling portion 212D may be arranged between the tub exhaust ports 220.

The reinforcing bracket 100D may include a rib reinforcing portion 130D for reinforcing the rigidity of the partition rib 230. The rib reinforcing portion 130D may include an inner rib reinforcing portion 132D that is provided to be fitted into an inner partition rib fitting portion 232Da). The inner rib reinforcing portion 132D may be formed by being bent from the rigidity reinforcing portion 110D. The inner rib reinforcing portion 132D may be formed approximately perpendicular to the rigidity reinforcing portion 110D.

The fitting of the inner rib reinforcing portion 132D into the inner partition rib 232 may provide a rigidity reinforcing effect similar to that of the insert injection.

However, the present disclosure is not limited thereto, and the rib reinforcing portion 130D may include an outer rib reinforcing portion and a connecting rib reinforcing portion that are provided to be fitted into the outer partition rib and the connecting partition rib. Correspondingly, the tub back may be provided with rib fitting portions into which the outer rib reinforcing portion and the connecting rib reinforcing portion may be fitted.

Figure 19:
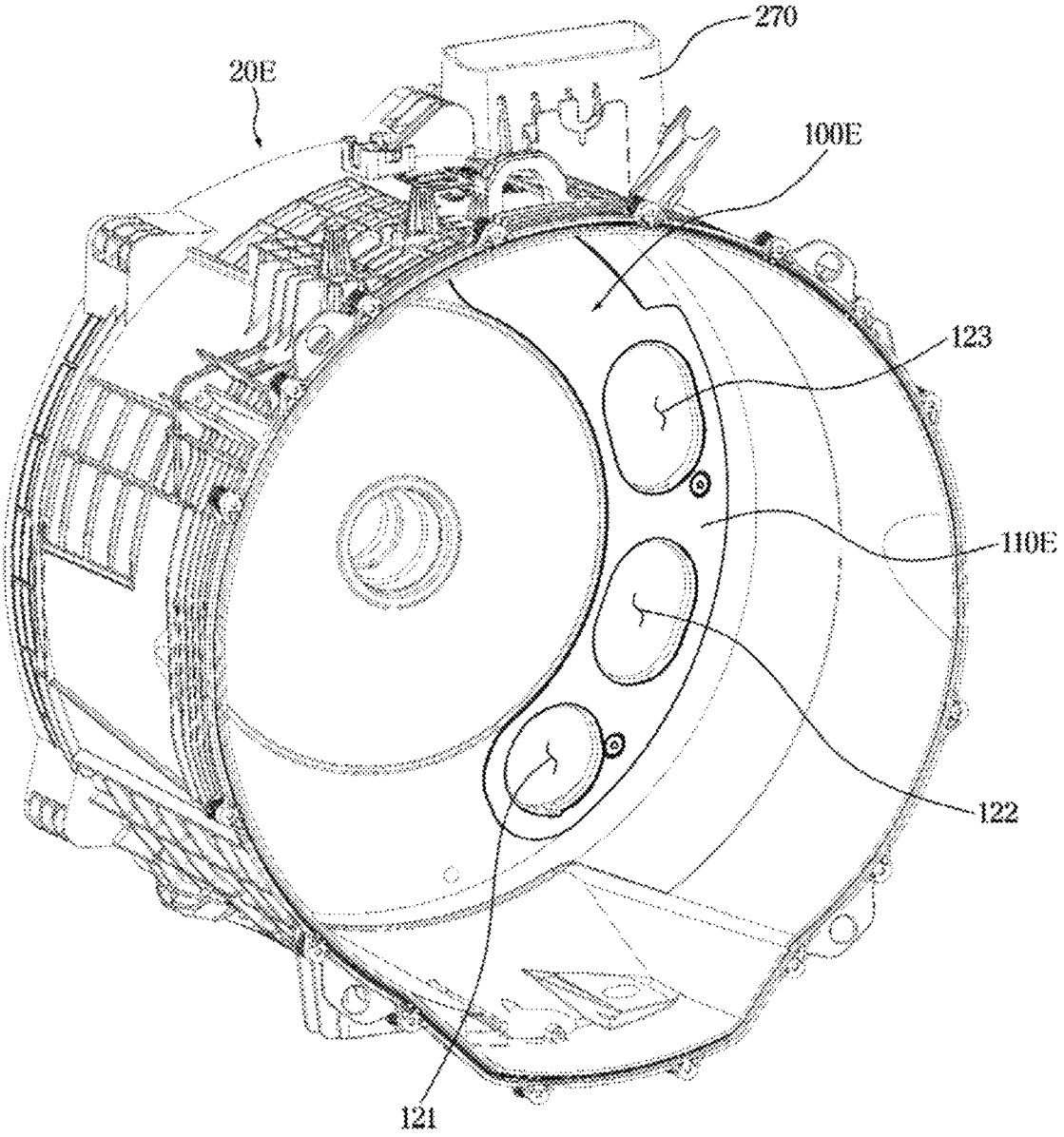
FIG. 19 is a view illustrating a state in which a reinforcing bracket is coupled to the inner side of a tub according to an embodiment.
Figure 20:
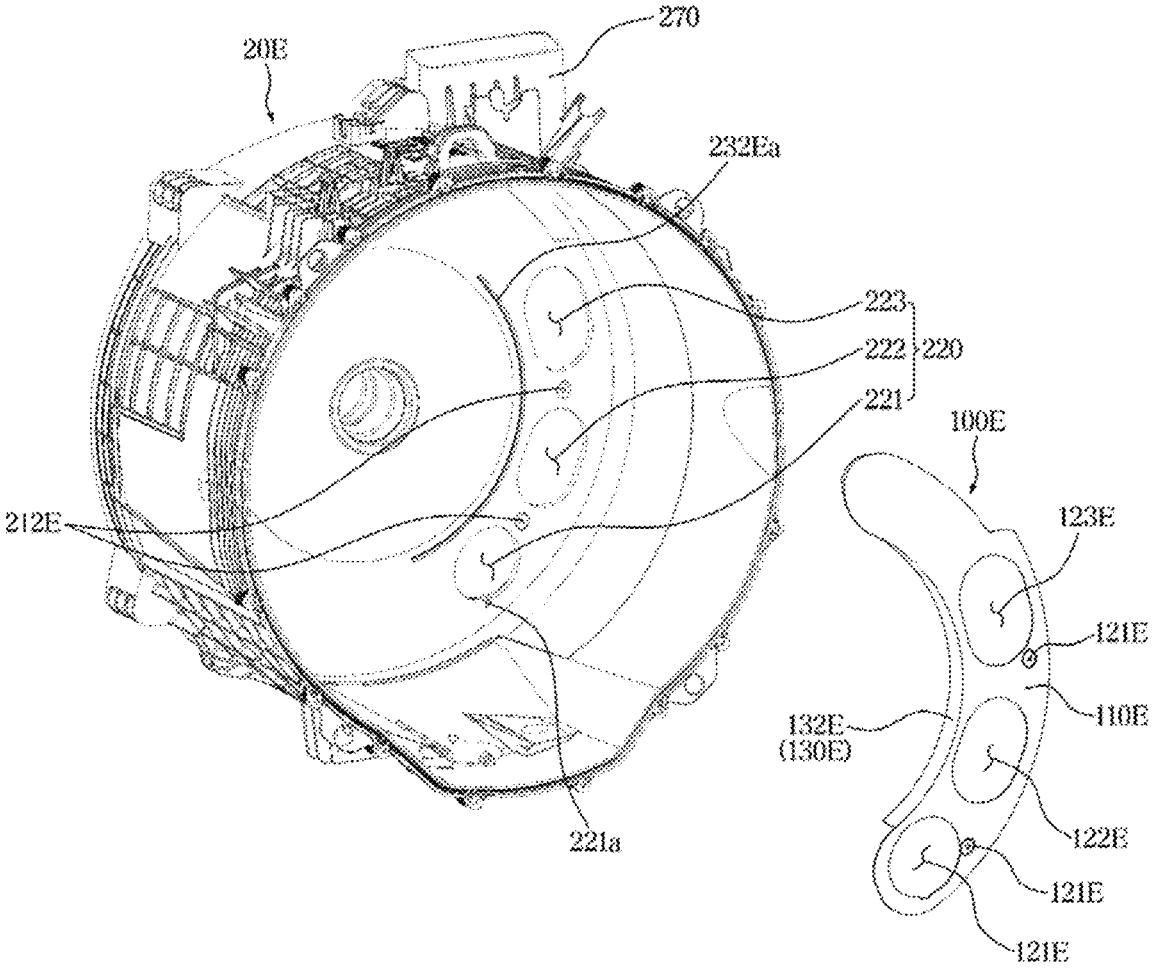
FIG. 20 is a view illustrating a state in which the reinforcing bracket and the tub shown in FIG. 19 are disassembled.

FIG. 19 is a view illustrating a state in which the reinforcing bracket is coupled to the inner side of the tub according to an embodiment. FIG. 20 is a view illustrating a state in which the reinforcing bracket and the tub shown in FIG. 19 are disassembled.

Referring to FIGS. 19 and 20, a reinforcing bracket 100E according to an embodiment of the present disclosure may be provided to correspond to a tub duct 213.

The reinforcing bracket 100E may be coupled to the inside of the tub 20. The reinforcing bracket 100E may be coupled to the front of the tub back 200. The reinforcing bracket 100E may be coupled to the front of the tub back 200 and disposed at a location corresponding to the second region R2.

Since the second region R2 may have a lower rigidity than the first region R1, the reinforcing bracket 100E may be coupled to the second region R2 to reinforce the rigidity of the second region R2 of the tub back 200.

The reinforcing bracket 100E may include a rib reinforcing portion 130E for reinforcing the rigidity of the partition rib 230. The rib reinforcing portion 130E may include an inner rib reinforcing portion 132E provided to reinforce the rigidity of the inner partition rib 232.

The inner rib reinforcing portion 132 may be provided to be fitted into the inner partition rib 232. The inner rib reinforcing portion 132 may be formed by being bent from the rigidity reinforcing portion 110E. The inner rib reinforcing portion 132 may be formed approximately perpendicular to the rigidity reinforcing portion 110E.

However, the disclosure is not limited thereto, and the rib reinforcing portion 130E may include an outer rib reinforcing portion and a connecting rib reinforcing portion provided to be fitted into the outer partition rib and the connecting partition rib. Correspondingly, the tub back may be provided with partition rib fitting portions into which the outer rib reinforcing portion and the connecting rib reinforcing portion may be fitted.

A clothes treating apparatus according to an embodiment includes a tub including a tub back forming a rear side of the tub, the tub back having a first region including a plurality of reinforcing ribs, and a second region including a tub exhaust port and a recessed portion forming an exhaust path along which air discharged through the tub exhaust port is flowable, a drum inside the tub, and the drum configured to accommodate laundry and to be rotatable, a rotatable shaft connected to the drum and configured to rotate the drum, a drying device at an upper side of the tub and configured to remove moisture from air discharged from the tub along the exhaust path, heat the discharged air, and supply the heated air back to the tub through the air inlet, a bearing housing coupled to the tub and configured to support the rotatable shaft, and a reinforcing bracket including a bracket exhaust port corresponding to the tub exhaust port and a rigidity reinforcing portion coupled to the recessed portion to reinforce a strength of the recessed portion.

The reinforcing bracket may be located outward of the bearing housing in a radial direction of the bearing housing.

The reinforcing bracket may be coupled to the bearing housing.

The tub back may further include a partition rib that divides the first region from the second region, and the reinforcing bracket includes a rib reinforcing portion corresponding to the partition rib to reinforce a rigidity of the partition rib.

The partition rib may extends along a periphery of the recessed portion, and the rib reinforcing portion may extend along a periphery of the rigidity reinforcing portion.

The reinforcing bracket may be inserted into the tub back.

The reinforcing bracket and the bearing housing may be inserted into the tub back.

The reinforcing bracket may be arranged in the second region, and located outside the tub.

The reinforcing bracket may further include a rib reinforcing portion extending along the partition rib to reinforce the rigidity of the partition rib.

The reinforcing bracket may be arranged in the second region, and located inside the tub.

The tub exhaust port may include a tub drainage groove configured to drain water toward an inside of the tub, and the bracket exhaust port includes a bracket drainage groove, corresponding to the tub drainage groove and configured to drain water toward the inside of the tub.

The reinforcing bracket may further include a bracket extension portion extending from the rigidity reinforcing portion along a circumferential direction of the bearing housing.

The bracket extension portion may be coupled to the tub back.

The recessed portion may further include a stepped portion stepped toward an inside of the tub so as to expand a cross-sectional area of the exhaust path, and the reinforcing bracket further includes an avoidance portion formed at a position corresponding to the stepped portion.

The avoidance portion may be formed by a groove or a hole in at least a portion of the reinforcing bracket.

According to an embodiment, there is provided a clothes treating apparatus including: a tub including a tub back having a first region, in which a plurality of reinforcing ribs protrude rearwardly, and a second region in which a tub exhaust port and a recessed portion are formed; a drum rotatably provided inside the tub; a drying device including a heat pump, the drying device being configured to supply heated air into the drum; a duct cover configured to cover the second region and configured to form an exhaust path for guiding air discharged from the tub exhaust port through the tub exhaust port to the drying device; a bearing housing inserted into the tub; and a reinforcing bracket including a bracket exhaust port corresponding to the tub exhaust port, and a rigidity reinforcing portion configured to be coupled to the recessed portion to reinforce rigidity of the recessed portion.

The reinforcing bracket may be configured to be coupled with the bearing housing.

The reinforcing bracket may further include a bracket extension portion that extends along the circumferential direction of the bearing housing and is arranged at an outer side along the radial direction of the bearing housing, and the rigid reinforcing portion may be arranged to be coupled with the recessed portion, and the bracket extension portion may be arranged to be coupled with the first region.

According to an embodiment, there is provided a clothes treating apparatus including: a tub including a partition rib configured to divide a first region in which a plurality of reinforcing ribs protrude, and a second region in which a recessed portion recessed from end portions of the plurality of reinforcing ribs and a tub exhaust port formed on the recessed portion are formed; a drum rotatably provided inside the tub; a drying device including a heat pump, the drying device being configured to supply heated air into the drum; a duct cover configured to cover the recessed portion to form an exhaust path such that air discharged from the drum through the tub exhaust port flows into the drying device; a bearing housing inserted into the tub; and a reinforcing bracket including a bracket exhaust port corresponding to the tub exhaust port, and a rigid reinforcing portion coupled to the recessed portion at an outer side of the bearing housing in a radial direction of the bearing housing.

The reinforcing bracket may be provided to be coupled with the bearing housing.

According to one aspect of the present disclosure, the space efficiency inside the clothes treating apparatus can be improved.

According to one aspect of the present disclosure, the tub bag can form a part of the exhaust path.

According to one aspect of the present disclosure, the strength reduction due to the improved structure of the tub can be prevented.

According to one aspect of the present disclosure, the clothes treating apparatus can include a reinforcing bracket whose structure is improved to correspond to the structure of the tub bag.

The effects of the present disclosure are not limited to the effects described above, and other effects that are not described will be clearly understood by those skilled in the art from the following description.

Specific embodiments illustrated in the drawings have been described above. However, the disclosure is not limited to the embodiments described above, and those of ordinary skill in the art to which the disclosure pertains may make various changes thereto without departing from the gist of the technical concept of the disclosure defined in the claims below.

The invention claimed is:

1. A clothes treating apparatus comprising:

a tub including a tub back forming a rear side of the tub, the tub back having a first region including a plurality of reinforcing ribs, and a second region including a tub exhaust port and a recessed portion forming an exhaust path along which air discharged through the tub exhaust port is flowable;

a drum inside the tub, the drum configured to accommodate laundry and to be rotatable;

a rotatable shaft connected to the drum and configured to rotate the drum;

a drying device provided at an upper side of the tub and configured to remove moisture from air discharged from the tub along the exhaust path, heat the discharged air, and supply the heated air back to the tub;

a bearing housing coupled to the tub and configured to support the rotatable shaft; and a reinforcing bracket including a bracket exhaust port corresponding to the tub exhaust port, and a rigidity reinforcing portion coupled to the recessed portion to reinforce a strength of the recessed portion.

2. The clothes treating apparatus of claim 1, wherein the reinforcing bracket is located outward of the bearing housing in a radial direction of the bearing housing.

3. The clothes treating apparatus of claim 1, wherein the reinforcing bracket is coupled to the bearing housing.

4. The clothes treating apparatus of claim 3, wherein the reinforcing bracket is arranged in the second region, and located inside the tub.

5. The clothes treating apparatus of claim 3, wherein the tub back further includes a partition rib that divides the first region from the second region, and the reinforcing bracket includes a rib reinforcing portion corresponding to the partition rib to reinforce a rigidity of the partition rib.

6. The clothes treating apparatus of claim 5, wherein the partition rib extends along a periphery of the recessed portion, and the rib reinforcing portion extends along a periphery of the rigidity reinforcing portion.

7. The clothes treating apparatus of claim 5, wherein the reinforcing bracket is inserted into the tub back.

8. The clothes treating apparatus of claim 7, wherein the reinforcing bracket and the bearing housing are inserted into the tub back.

9. The clothes treating apparatus of claim 5, wherein the reinforcing bracket is arranged in the second region, and located outside the tub.

10. The clothes treating apparatus of claim 1, wherein the tub exhaust port includes a tub drainage groove configured to drain water toward an inside of the tub, and the bracket exhaust port includes a bracket drainage groove corresponding to the tub drainage groove and configured to drain water toward the inside of the tub.

11. The clothes treating apparatus of claim 1, wherein the reinforcing bracket further includes a bracket extension portion extending from the rigidity reinforcing portion along a circumferential direction of the bearing housing.

12. The clothes treating apparatus of claim 11, wherein the bracket extension portion is coupled to the tub back.

13. The clothes treating apparatus of claim 1, wherein the recessed portion further includes a stepped portion that is stepped toward an inside of the tub so as to expand a cross-sectional area of the exhaust path, and the reinforcing bracket further includes an avoidance portion formed at a position corresponding to the stepped portion.

14. The clothes treating apparatus of claim 13, wherein the avoidance portion is formed by a groove or a hole in at least a portion of the reinforcing bracket.

* * * * *